US008789464B2

(12) United States Patent
Tagawa et al.

(10) Patent No.: US 8,789,464 B2
(45) Date of Patent: Jul. 29, 2014

(54) LITHOGRAPHIC PRINTING PLATE SUPPORT AND PRESENSITIZED PLATE

(75) Inventors: Yoshiharu Tagawa, Shizuoka (JP); Hirokazu Sawada, Shizuoka (JP); Atsuo Nishino, Shizuoka (JP); Shinya Kurokawa, Shizuoka (JP); Yuya Miyagawa, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 718 days.

(21) Appl. No.: 13/097,228

(22) Filed: Apr. 29, 2011

(65) Prior Publication Data

US 2011/0265673 A1 Nov. 3, 2011

(30) Foreign Application Priority Data

Apr. 30, 2010 (JP) ..... 2010-105970
Feb. 28, 2011 (JP) ..... 2011-042603

(51) Int. Cl.

| | |
|---|---|
| ***B41N 1/08*** | (2006.01) |
| ***C25D 11/12*** | (2006.01) |
| ***B41N 3/03*** | (2006.01) |
| *B41C 1/10* | (2006.01) |

(52) U.S. Cl.

CPC ..... *B41N 3/034* (2013.01); *B41N 1/083* (2013.01); *C25D 11/12* (2013.01); *B41C 1/1008* (2013.01)

USPC ..... 101/401.1; 205/69; 205/127

(58) Field of Classification Search

None

See application file for complete search history.

(56) References Cited

U.S. PATENT DOCUMENTS

| | | | | |
|---|---|---|---|---|
| 2003/0031860 | A1 | 2/2003 | Hotta et al. | |
| 2003/0148207 | A1 | 8/2003 | Maemoto et al. | |
| 2012/0192742 | A1 * | 8/2012 | Kurokawa et al. | 101/453 |
| 2012/0298001 | A1 * | 11/2012 | Kurokawa et al. | 101/459 |

FOREIGN PATENT DOCUMENTS

| | | | |
|---|---|---|---|
| JP | 11-291657 | A | 10/1999 |
| JP | 2003-034090 | A | 2/2003 |
| JP | 2003-034091 | A | 2/2003 |
| JP | 2003-103951 | A | 4/2003 |
| JP | 2007-237397 | A | 9/2007 |

* cited by examiner

*Primary Examiner* — Joshua D Zimmerman

(74) *Attorney, Agent, or Firm* — Sughrue Mion, PLLC

(57) ABSTRACT

The lithographic printing plate support includes an aluminum plate and an anodized film formed on the aluminum plate and micropores extend in the anodized film in a depth direction from its surface opposite from the aluminum plate. Each of the micropores includes a large-diameter portion having a predetermined shape and a small-diameter portion having a predetermined shape. The lithographic printing plate support has excellent scratch resistance and is capable of obtaining a presensitized plate which exhibits excellent on-press developability and enables a lithographic printing plate formed therefrom to have a long press life, and excellent deinking ability in continued printing and after suspended printing.

9 Claims, 4 Drawing Sheets

LITHOGRAPHIC PRINTING PLATE SUPPORT AND PRESENSITIZED PLATE

TECHNICAL FIELD

The present invention relates to a lithographic printing plate support and a presensitized plate.

BACKGROUND ART

Lithographic printing is a printing process that makes use of the inherent immiscibility of water and oil. Lithographic printing plates used in lithographic printing have formed on a surface thereof regions which are receptive to water and repel oil-based inks (referred to below as "non-image areas") and regions which repel water and are receptive to oil-based inks (referred to below as "image areas").

The aluminum support employed in a lithographic printing plate (referred to below simply as a "lithographic printing plate support") is used in such a way as to carry non-image areas on its surface. It must therefore have a number of conflicting properties, including, on the one hand, an excellent hydrophilicity and water retention and, on the other hand, an excellent adhesion to the image recording layer that is provided thereon. If the hydrophilicity of the support is too low, ink is likely to be attached to the non-image areas at the time of printing, causing a blanket cylinder to be scummed and thereby causing so-called scumming to be generated. In addition, if the water retention of the support is too low, clogging in the shadow area is generated unless the amount of fountain solution is increased at the time of printing. Thus, a so-called water allowance is narrowed.

Various studies have been made to obtain lithographic printing plate supports exhibiting good properties. For example, JP 11-291657 A discloses a method of manufacturing a lithographic printing plate support which includes a first step for anodizing a roughened aluminum plate surface and a second step for reanodizing under such conditions that the diameter of micropores may be smaller than that in the anodized film formed in the first step. It is described that the lithographic printing plate obtained using the lithographic printing plate support does not deteriorate the deinking ability in continued printing, improves the adhesion to the photosensitive layer, does not cause highlight areas to be blocked up, and has a long press life. The deinking ability in continued printing is an ability related to the number of sheets wasted before the ink on non-image areas is completely removed in the course of printing, and is rated "good" when the number of wasted sheets is small.

On the other hand, printing may be suspended. In such a case, the lithographic printing plate is left to stand on the plate cylinder and its non-image areas may be scummed under the influence of the contamination in the atmosphere. Therefore, when the printing having been suspended is resumed, a number of sheets must be printed until normal printing can be made, thus causing wasted use of printing paper or other defect. It is known that these defects prominently occur in the lithographic printing plates having undergone electrochemical graining treatment in an acidic solution containing hydrochloric acid. In the following description, the number of sheets wasted when the printing having been suspended is resumed is used to evaluate the deinking ability after suspended printing and the deinking ability after suspended printing is rated "good" when the number of wasted sheets is small.

In addition, a large number of researches have been made on computer-to-plate (CTP) systems which are under remarkable progress in recent years. In particular, a presensitized plate which can be mounted for printing on a printing press without being developed after exposure to light has been required to solve the problem of wastewater treatment while further rationalizing the process.

One of the methods for eliminating a treatment step is a method called "on-press development" in which an exposed presensitized plate is mounted on a plate cylinder of a printing press and fountain solution and ink are supplied as the plate cylinder is rotated to thereby remove non-image areas of the presensitized plate. In other words, this is a system in which the exposed presensitized plate is mounted on the printing press without any further treatment so that development may complete in the usual printing process. The presensitized plate suitable for use in such on-press development is required to have an image recording layer which is soluble in fountain solution or an ink solvent and to have a light-room handling property suitable to the development on a printing press placed in a light room. In the following description, the number of sheets of printed paper required to reach the state in which no ink is transferred to non-image areas after the completion of the on-press development of the unexposed areas is used to evaluate the on-press developability, which is rated "good" when the number of wasted sheets is small.

JP 2003-034090 A, JP 2003-034091 A, JP 2003-103951 A and JP 2007-237397 A disclose techniques to obtain the presensitized plates satisfying the foregoing properties. These documents each disclose a method of manufacturing a lithographic printing plate support by performing anodizing treatment in two steps as in JP 11-291657 A mentioned above.

SUMMARY OF THE INVENTION

On the other hand, according to the recent market trends, lithographic printing plates and presensitized plates having more excellent productivity and higher printability are needed, and levels required for the properties such as press life, deinking ability after suspended printing, on-press developability and deinking ability in continued printing are further increasing.

The inventors of the invention have made studies on various properties of the lithographic printing plates and the presensitized plates obtained using lithographic printing plate supports which are obtained by performing anodizing treatment in two steps as specifically described in the five patent documents mentioned above, and as a result found that these properties do not meet the levels required in recent years. In other words, it was not necessarily easy to achieve simple printing while keeping high image quality. In addition, it has been found that the scratch resistance of the lithographic printing plate support is also to be improved.

In view of the situation as described above, an object of the invention is to provide a lithographic printing plate support that has excellent scratch resistance and is capable of obtaining a presensitized plate which exhibits excellent on-press developability and enables a lithographic printing plate formed therefrom to have a long press life, and excellent deinking ability in continued printing and after suspended printing. Another object of the invention is to provide a method of manufacturing such a lithographic printing plate support. Still another object of the invention is to provide a presensitized plate.

The inventors of the invention have made an intensive study to achieve the objects and as a result found that the foregoing problems can be solved by controlling the shape of micropores in the anodized film.

Specifically, the invention provides the following (1) to (6).

(1) A lithographic printing plate support comprising:

an aluminum plate; and an anodized film formed on the aluminum plate, micropores extending in the anodized film in a depth direction from its surface opposite from the aluminum plate, wherein each of the micropores has a large-diameter portion which extends to a depth A of 5 to 60 nm from the surface of the anodized film, and a small-diameter portion which communicates with a bottom of the large-diameter portion and extends to a depth of 900 to 2,000 nm from a communication position between the small-diameter portion and the large-diameter portion, wherein the large-diameter portion has a diameter which gradually increases from the surface of the anodized film toward the aluminum plate, an average bottom diameter of the large-diameter portion as measured at the communication position is larger than a surface layer average diameter of the large-diameter portion as measured at the surface of the anodized film, the average bottom diameter is from 10 to 60 nm, and a ratio of the depth A to the average bottom diameter is 0.1 to 4.0, wherein a small-diameter portion average diameter as measured at the communication position is more than 0 nm but less than 20 nm, and wherein a ratio of the small-diameter portion average diameter to the average bottom diameter is up to 0.85.

(2) The lithographic printing plate support according to (1), wherein the anodized film has a thickness of at least 20 nm between a bottom of the small-diameter portion and a surface of the aluminum plate.

(3) The lithographic printing plate support according to (1) or (2), wherein the micropores are formed at a density of 100 to 3,000 micropores/$\mu m^2$.

(4) A method of manufacturing the lithographic printing plate support according to any one of (1) to (3), the method comprising:

a first anodizing treatment step for anodizing the aluminum plate; and a second anodizing treatment step for further anodizing the aluminum plate having the anodized film obtained in the first anodizing treatment step.

(5) A presensitized plate comprising:

the lithographic printing plate support according to any one of (1) to (3); and an image recording layer formed thereon.

(6) The presensitized plate according to (5), wherein the image recording layer is one in which an image is formed by exposure to light and unexposed portions are removable by printing ink and/or fountain solution.

The invention can provide a lithographic printing plate support that has excellent scratch resistance and is capable of obtaining a presensitized plate which exhibits excellent on-press developability and enables a lithographic printing plate formed therefrom to have a long press life, and excellent deinking ability in continued printing and after suspended printing; a method of manufacturing such a lithographic printing plate support; and a presensitized plate.

DETAILED DESCRIPTION OF THE INVENTION

The lithographic printing plate support and its manufacturing method according to the invention are described below.

The lithographic printing plate support of the invention includes an aluminum plate and an anodized film formed thereon, each of micropores in the anodized film being of such a shape that a large-diameter portion having a larger average diameter communicates with a small-diameter portion having a smaller average diameter along the depth direction (i.e., the thickness direction) of the film. It was found that particularly in the invention, the properties such as press life, on-press developability and deinking ability in continued printing and after suspended printing can be kept at high levels by controlling the shape (depth or average diameter) of the large-diameter portions.

A preferred embodiment of the method of manufacturing the lithographic printing plate support of the invention includes a first anodizing treatment step for anodizing an aluminum plate and a second anodizing treatment step for further anodizing the aluminum plate having an anodized film obtained in the first anodizing treatment step.

It was found that a lithographic printing plate support having desired properties can be obtained in the invention by particularly controlling the temperature of the electrolytic solution used in the anodizing treatment step. More specifically, it was found that by controlling the temperature conditions of the electrolytic solutions in the respective treatment steps, micropores formed in the first anodizing treatment can be opened in the second anodizing treatment to increase the surface area, and the micropores with larger surface areas have high adhesion to a photosensitive layer formed thereon.

[Lithographic Printing Plate Support]

Figure 1A:
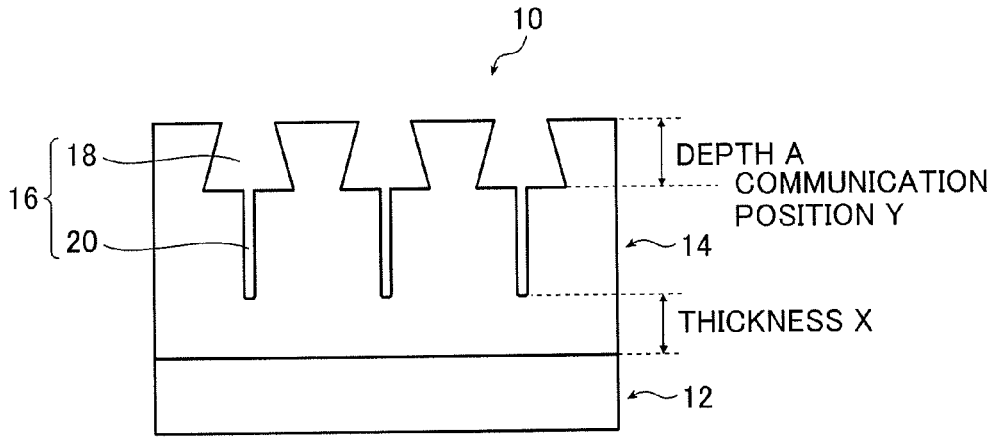
FIG. 1A is a schematic cross-sectional view showing an embodiment of a lithographic printing plate support of the invention.

FIG. 1A is a schematic cross-sectional view showing an embodiment of the lithographic printing plate support of the invention.

A lithographic printing plate support 10 shown in FIG. 1A is of a laminated structure in which an aluminum plate 12 and an anodized aluminum film 14 are stacked in this order. The anodized film 14 has micropores 16 extending from its surface toward the aluminum plate 12 side, and each micropore 16 has a large-diameter portion 18 and a small-diameter portion 20. The term "micropore" is commonly used to denote a pore in the anodized film and does not define the size of the pore.

The aluminum plate 12 and the anodized film 14 are first described in detail.

[Aluminum Plate]

The aluminum plate 12 (aluminum support) used in the invention is made of a dimensionally stable metal composed primarily of aluminum; that is, aluminum or aluminum alloy. The aluminum plate is selected from among plates of pure aluminum, alloy plates composed primarily of aluminum and containing small amounts of other elements, and plastic films or paper on which aluminum (alloy) is laminated or vapor-deposited. In addition, a composite sheet as described in JP 48-18327 B in which an aluminum sheet is attached to a polyethylene terephthalate film may be used.

In the following description, the above-described plates made of aluminum or aluminum alloys are referred to collectively as "aluminum plate 12." Other elements which may be present in the aluminum alloy include silicon, iron, manganese, copper, magnesium, chromium, zinc, bismuth, nickel and titanium. The content of other elements in the alloy is not more than 10 wt %. In the invention, the aluminum plate used is preferably made of pure aluminum but may contain small amounts of other elements because it is difficult to manufacture completely pure aluminum from the viewpoint of smelting technology. The aluminum plate 12 which is applied to the invention as described above is not specified for its composition but conventionally known materials such as JIS A1050, JIS A1100, JIS A3103 and JIS A3005 materials can be appropriately used.

The aluminum plate 12 used in the invention is treated as it continuously travels usually in a web form, and has a width of about 400 mm to about 2,000 mm and a thickness of about 0.1 mm to about 0.6 mm. The width and thickness may be changed as appropriate based on such considerations as the size of the printing press, the size of the printing plate and the desires of the user.

The aluminum plate 12 is appropriately subjected to substrate surface treatments to be described later.

[Anodized Film]

The anodized film 14 refers to an anodized aluminum film that is generally formed at a surface of the aluminum plate 12 by anodizing treatment and has the micropores 16 which are substantially vertical to the film surface and are individually distributed in a uniform manner. The micropores 16 extend along the thickness direction of the anodized film 14 from the surface of the anodized film opposite to the aluminum plate 12 toward the aluminum plate 12 side.

Each micropore 16 in the anodized film 14 has the large-diameter portion 18 which extends to a depth of 5 to 60 nm from the anodized film surface (depth A: see FIG. 1A), and the small-diameter portion 20 which communicates with the bottom of the large-diameter portion 18 and further extends to a depth of 900 to 2,000 nm from the communication position Y.

The large-diameter portion 18 and the small-diameter portion 20 are described below in detail.

(Large-Diameter Portion)

The diameter (inner diameter) of the large-diameter portions 18 gradually increases from the surface of the anodized film toward the aluminum plate side. The shape of the large-diameter portions 18 is not particularly limited as long as the diameter condition is met and a substantially conical shape and a substantially bell shape are preferred. The lithographic printing plate formed using the lithographic printing plate support having the large-diameter portions of the foregoing structure has a long press life and excellent deinking ability in continued printing and after suspended printing and the presensitized plate obtained using the support has excellent on-press developability.

The average diameter (average bottom diameter) of the large-diameter portions 18 as measured at the communication position Y is larger than the average diameter (surface layer average diameter) of the large-diameter portions 18 as measured at the surface of the anodized film. If this condition is met, the lithographic printing plate obtained using the lithographic printing plate support has a long press life and excellent deinking ability in continued printing and after suspended printing and the presensitized plate obtained using the support has excellent on-press developability. In particular, in terms of longer press life, the average bottom diameter is preferably larger by at least 5 nm, more preferably at least 10 nm and most preferably at least 15 nm than the surface layer average diameter. There is no particular limitation on the upper limit of the difference between the average bottom diameter and the surface layer average diameter, but the difference is preferably up to 50 nm due to manufacturing limitations.

If the average bottom diameter is equal to or smaller than the surface layer average diameter, the deinking ability in continued printing is particularly poor.

The large-diameter portions 18 have an average bottom diameter of 10 to 60 nm. At an average bottom diameter within the foregoing range, the lithographic printing plate obtained using the lithographic printing plate support has a long press life and excellent deinking ability in continued printing and after suspended printing and the presensitized plate obtained using the support has excellent on-press developability. In terms of longer press life of the lithographic printing plate obtained using the lithographic printing plate support, the average bottom diameter is preferably from 10 to 50 nm, more preferably from 12 to 50 nm and even more preferably from 20 to 50 nm.

At an average bottom diameter of less than 10 nm, a sufficient anchor effect is not obtained, nor is the press life of the lithographic printing plate improved. At an average bottom diameter in excess of 60 nm, the roughened surface is damaged whereby the properties such as press life and deinking ability in continued printing and after suspended printing cannot be improved.

The surface layer average diameter of the large-diameter portions 18 is not limited as long as it has a specified relation with the average bottom diameter. The surface layer average diameter is preferably at least 10 nm, more preferably from 12 to 40 nm and even more preferably from 14 to 30 nm in terms of more excellent effects of the invention.

The surface layer average diameter of the large-diameter portions 18 is determined by observing the surface of the anodized film 14 by FE-TEM at a magnification of 500,000×, measuring the diameter of 60 (N=60) micropores (large-diameter portions) and calculating the average of the measurements.

The average bottom diameter of the large-diameter portions 18 is determined by observing the cross-sectional surface at the communication position Y of the anodized film 14 by FE-TEM at a magnification of 500,000×, measuring the diameter of 60 (N=60) micropores (large-diameter portions) and calculating the average of the measurements. Any known method may be applied to make the measurement on the cross-sectional surface of the anodized film. For example, the anodized film is cut by focused ion beam (FIB) milling to prepare a thin film with a thickness of about 50 nm, which is used to make the measurement on the cross-sectional surface of the anodized film 14.

The equivalent circle diameter is used if the aperture and bottom of the large-diameter portion 18 are not circular. The "equivalent circle diameter" refers to a diameter of a circle assuming that the shape of an aperture (bottom) is the circle having the same projected area as that of the aperture (bottom).

The bottom of each large-diameter portion 18 is at a depth of 5 to 60 nm from the surface of the anodized film (hereinafter this depth is also referred to as "depth A"). In other words, each large-diameter portion 18 is a pore which extends from the surface of the anodized film in the depth direction (thickness direction of the anodized film) to a depth of 5 to 60 nm. The depth is preferably from 10 nm to 50 nm from the viewpoint that the lithographic printing plate obtained using the lithographic printing plate support has a longer press life and more excellent deinking ability in continued printing and after suspended printing and the presensitized plate obtained using the support has more excellent on-press developability.

At a depth of less than 5 nm, a sufficient anchor effect is not obtained, nor is the press life of the lithographic printing plate improved, and the presensitized plate has poor on-press developability. At a depth in excess of 60 nm, the lithographic printing plate has poor deinking ability after suspended printing and the presensitized plate has poor on-press developability.

The depth is determined by taking a cross-sectional image of the anodized film 14 at a magnification of 150,000×, measuring the depth of at least 25 large-diameter portions, and calculating the average of the measurements.

The ratio of the depth A of the large-sized portions 18 to the average bottom diameter of the large-sized portions 18 (depth A/average bottom diameter) is from 0.1 to 4.0. The ratio of the depth A to the average bottom diameter is preferably at least 0.3 but less than 3.0, and more preferably at least 0.3 but less than 2.5 from the viewpoint that the lithographic printing plate obtained using the lithographic printing plate support has a longer press life and more excellent deinking ability in continued printing and after suspended printing and that the presensitized plate obtained using the support has more excellent on-press developability.

At a ratio of the depth A to the average bottom diameter of less than 0.1, the press life of the lithographic printing plate is not improved. At a ratio of the depth A to the average bottom diameter in excess of 4.0, the lithographic printing plate has poor deinking ability in continued printing and after suspended printing and the presensitized plate has poor on-press developability.

(Small-Diameter Portion)

As shown in FIG. 1A, each of the small-diameter portions 20 is a pore which communicates with the bottom of the corresponding large-diameter portion 18 and further extends from the communication position in the depth direction (i.e., in the thickness direction). One small-diameter portion 20 usually communicates with one large-diameter portion 18 but two or more small-diameter portions 20 may communicate with one large-diameter portion 18.

The small-diameter portions 20 have an average diameter at the communication position of more than 0 but less than 20 nm. The average diameter is preferably up to 15 nm, more preferably up to 13 nm and most preferably from 5 to 10 nm in terms of the deinking ability in continued printing and after suspended printing and on-press developability.

At an average diameter of 20 nm or more, the lithographic printing plate obtained using the lithographic printing plate support of the invention has poor deinking ability in continued printing and after suspended printing and the presensitized plate has poor on-press developability.

The average diameter of the small-diameter portions 20 at the communication position Y is determined by observing the cross-sectional surface at the communication position Y of the anodized film 14 by FE-TEM at a magnification of 500,000×, measuring the diameter of 60 (N=60) micropores (small-diameter portions) and calculating the average of the measurements. Any known method may be applied to make the measurement on the cross-sectional surface of the anodized film. For example, the anodized film is cut by FIB milling to prepare a thin film with a thickness of about 50 nm, which is used to make the measurement on the cross-sectional surface of the anodized film 14.

The equivalent circle diameter is used if the small-diameter portion 20 is not cylindrical. The "equivalent circle diameter" refers to a diameter of a circle assuming that the shape of an aperture (bottom) is the circle having the same projected area as that of the aperture (bottom).

The bottom of each small-diameter portion 20 is at a distance of 900 to 2,000 nm in the depth direction from the communication position with the corresponding large-diameter portion 18 which has the depth A up to the communication position. In other words, the small-diameter portions 20 are pores each of which further extends in the depth direction (thickness direction) from the communication position Y with the corresponding large-diameter portion 18 and the small-diameter portions 20 have a depth of 900 to 2,000 nm. The bottom of each small-diameter portion 20 is preferably at a depth of 900 to 1,500 nm from the communication position in terms of the scratch resistance of the lithographic printing plate support.

At a depth of less than 900 nm, the lithographic printing plate support has poor scratch resistance. A depth in excess of 2,000 nm requires a prolonged treatment time and reduces the productivity and economic efficiency.

The depth is determined by taking a cross-sectional image of the anodized film 14 (cross-sectional image in the thickness direction) at a magnification of 50,000×, measuring the depth of at least 25 small-diameter portions, and calculating the average of the measurements.

The ratio of the average diameter of the small-diameter portions 20 at the communication position (small-diameter portion diameter) and the average bottom diameter of the large-diameter portions 18 (small-diameter portion diameter/average bottom diameter) is up to 0.85. The lower limit of this ratio is more than 0, preferably from 0.02 to 0.85 and more preferably from 0.1 to 0.70. At an average diameter ratio within the foregoing range, the resulting lithographic printing plate has a longer press life and more excellent deinking ability in continued printing and after suspended printing and the presensitized plate has more excellent on-press developability.

At an average diameter ratio in excess of 0.85, a good balance cannot be struck between the press life and the deinking ability after suspended printing/on-press developability.

The shape of the small-diameter portions 20 is not particularly limited. Exemplary shapes include a substantially straight tubular shape (substantially columnar shape), and an inverted conical shape in which the diameter decreases in the depth direction, and a substantially straight tubular shape is preferred. The bottom shape of the small-diameter portions 20 is not particularly limited and may be curved (convex) or flat.

The internal diameter of the small-diameter portions 20 is not particularly limited and may be usually substantially equal to, smaller than or larger than the diameter at the communication position. There may be usually a difference of about 1 nm to about 10 nm between the internal diameter of the small-diameter portions 20 and the diameter of the small-diameter portions 20 at the communication position.

The thickness between the bottom of each small-diameter portion 20 in the anodized film and the surface of the aluminum plate 12 which corresponds to the thickness X in FIG. 1A is not particularly limited and is preferably at least 20 nm. The portion corresponding to the thickness X in the anodized film is also called "barrier layer". A thickness X within the above-defined range enables the lithographic printing plate obtained to have high resistance to spotting and formation of perfect circle-shaped white spots. In particular, the thickness X is preferably at least 22 nm and more preferably at least 24 nm because the foregoing effects are more excellent. The upper limit is not particularly limited and the thickness X is preferably up to 35 nm in terms of the uniform film formation and formation rate.

In cases where the presensitized plate is stored for a long period of time, ink is prone to adhere to part of the non-image area surface, causing dot- or ring-shaped stains on printed paper. This defect is also hereinafter referred to as "spotting".

The perfect circle-shaped white spot refers to lack of image in a perfect circle shape which may occur when printing is made using a lithographic printing plate obtained by exposing and developing a presensitized plate after a long-term storage, the presensitized plate being obtained by forming a photopolymer type image recording layer on the lithographic printing plate support.

The spotting and occurrence of perfect circle-shaped white spots can be suppressed by controlling the thickness X as described above.

(Preferred Embodiment of Small-Diameter Portions)

Figure 1B:
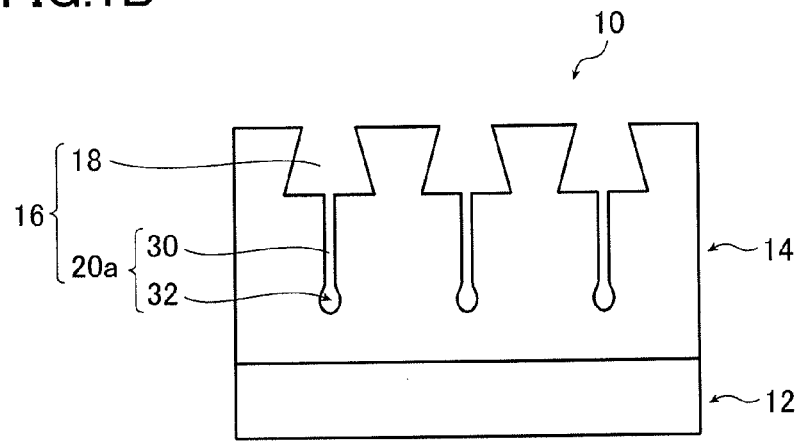
FIG. 1B is a schematic cross-sectional view showing another embodiment of the lithographic printing plate support.

A preferred embodiment of the small-diameter portions is a small-diameter portion 20*a* as shown in FIG. 1B which includes a main pore portion 30 and an enlarged-diameter portion 32 connected together along the thickness direction of the anodized film 16. The small-diameter portions having the structure described above enable the lithographic printing plate obtained using the lithographic printing plate support to have more excellent resistance to spotting.

The main pore portion 30 is a pore portion which extends from the communication position between the small-diameter portion 20*a* and the large-diameter portion 18 (hereinafter referred to as "communication position Y") toward the aluminum plate 12 side and is a main part of the small-diameter portion 20*a*.

The main pore portion 30 is usually in a substantially straight tubular shape as shown in FIG. 1B. The internal diameter of the main pore portion 30 may have a difference of about 1 nm to about 5 nm along the thickness direction of the anodized film 16.

The enlarged-diameter portion 32 is a pore portion which communicates with one end of the main pore portion 30, extends toward the aluminum plate 12 side and has the maximum diameter larger than the maximum value of the internal diameter of the main pore portion 30. For example, the enlarged-diameter portion 32 may be an inversely tapered portion (substantially bell-shaped portion) in which the pore diameter enlarges from the lower end of the main pore portion 30 toward the aluminum plate 12 side.

The enlarged-diameter portions 32 preferably have an average maximum diameter of at least 6 nm and more preferably 8 to 30 nm.

The average difference between the maximum diameter of the enlarged-diameter portions 32 and the maximum value of the internal diameter of the main pore portions 30 is preferably at least 3 nm and more preferably 6 to 25 nm.

Of the total depth of the small-diameter portion 20*a* from the communication position Y to its bottom, the depth of the main pore portion 30 having a substantially straight tubular shape usually accounts for 40 to 98% and that of the enlarged-diameter portion 32 accounts for the remaining percentage.

The density of the micropores 16 in the anodized film 14 is not particularly limited and the anodized film 14 preferably has 50 to 4,000 micropores/$\mu m^2$, and more preferably 100 to 3,000 micropores/$\mu m^2$ because the resulting lithographic printing plate has a longer press life, and excellent deinking ability in continued printing and after suspended printing and the presensitized plate has excellent on-press developability.

The coating weight of the anodized film 14 is not particularly limited and is preferably 2.3 to 5.5 g/$m^2$ and more preferably 2.3 to 4.0 g/$m^2$ in terms of excellent scratch resistance of the lithographic printing plate support.

The above-described lithographic printing support having an image recording layer to be described later formed on a surface thereof can be used as a presensitized plate.

[Method of Manufacturing Lithographic Printing Plate Support]

According to the method of manufacturing the lithographic printing plate support of the invention, a manufacturing method in which the following steps are performed in order is preferred.

(Surface roughening treatment step) Step of surface roughening treatment on an aluminum plate;

(First anodizing treatment step) Step of anodizing the aluminum plate having undergone surface roughening treatment;

(Second anodizing treatment step) Step of further anodizing the aluminum plate obtained in the first anodizing treatment step;

(Third anodizing treatment step) Step of further anodizing the aluminum plate obtained in the second anodizing treatment step;

(Hydrophilizing treatment step) Step of hydrophilizing the aluminum plate obtained in the third anodizing treatment step.

The surface roughening treatment step, the third anodizing treatment step and the hydrophilizing treatment step are not essential steps for the beneficial effects of the invention.

The respective steps are described below in detail.

[Surface Roughening Treatment Step]

The surface roughening treatment step is a step in which the surface of the aluminum plate is subjected to surface roughening treatment including electrochemical graining treatment. This step is preferably performed before the first anodizing treatment step to be described later but may not be performed if the aluminum plate already has a preferred surface shape.

Electrochemical graining treatment may only be performed for the surface roughening treatment, but electrochemical graining treatment may be performed in combination with mechanical graining treatment and/or chemical graining treatment.

In cases where mechanical graining treatment is combined with electrochemical graining treatment, mechanical graining treatment is preferably followed by electrochemical graining treatment.

In the practice of the invention, electrochemical graining treatment is preferably performed in an aqueous solution of nitric acid or hydrochloric acid.

Mechanical graining treatment is generally performed in order that the surface of the aluminum plate may have a surface roughness $R_a$ of 0.35 to 1.0 μm.

In the invention, mechanical graining treatment is not particularly limited for its conditions and can be performed according to the method described in, for example, JP 50-40047 B. Mechanical graining treatment can be performed by brush graining using a suspension of pumice or by a transfer system.

Chemical graining treatment is also not particularly limited and may be performed by any known method.

Mechanical graining treatment is preferably followed by chemical etching treatment described below.

The purpose of chemical etching treatment following mechanical graining treatment is to smooth edges of irregularities at the surface of the aluminum plate to prevent ink from catching on the edges during printing, to improve the scumming resistance of the lithographic printing plate, and to remove abrasive particles or other unnecessary substances remaining on the surface.

Chemical etching processes including etching using an acid and etching using an alkali are known in the art, and an exemplary method which is particularly excellent in terms of etching efficiency includes chemical etching treatment using an aqueous alkali solution. This treatment is hereinafter referred to as "alkali etching treatment."

Alkaline agents that may be used in the alkali solution are not particularly limited and illustrative examples of suitable alkaline agents include sodium hydroxide, potassium hydroxide, sodium metasilicate, sodium carbonate, sodium aluminate, and sodium gluconate.

The alkaline agents may contain aluminum ions. The alkali solution has a concentration of preferably at least 0.01 wt % and more preferably at least 3 wt %, but preferably not more than 30 wt % and more preferably not more than 25 wt %.

The alkali solution has a temperature of preferably room temperature or higher, and more preferably at least 30° C., but preferably not more than 80° C., and more preferably not more than 75° C.

The amount of material removed from the aluminum plate (also referred to below as the "etching amount") is preferably at least 0.1 $g/m^2$ and more preferably at least 1 $g/m^2$, but preferably not more than 20 $g/m^2$ and more preferably not more than 10 $g/m^2$.

The treatment time is preferably from 2 seconds to 5 minutes depending on the etching amount and more preferably from 2 to 10 seconds in terms of improving the productivity.

In cases where mechanical graining treatment is followed by alkali etching treatment in the invention, chemical etching treatment using an acid solution at a low temperature (hereinafter also referred to as "desmutting treatment") is preferably performed to remove substances produced by alkali etching treatment.

Acids that may be used in the acid solution are not particularly limited and illustrative examples thereof include sulfuric acid, nitric acid and hydrochloric acid. The acid solution preferably has a concentration of 1 to 50 wt %. The acid solution preferably has a temperature of 20 to 80° C. When the concentration and temperature of the acid solution fall within the above-defined ranges, a lithographic printing plate obtained using the inventive lithographic printing plate support has a more improved resistance to spotting.

In the practice of the invention, the surface roughening treatment is a treatment in which electrochemical graining treatment is performed after mechanical graining treatment and chemical etching treatment are performed as desired, but also in cases where electrochemical graining treatment is performed without performing mechanical graining treatment, electrochemical graining treatment may be preceded by chemical etching treatment using an aqueous alkali solution such as sodium hydroxide. In this way, impurities which are present in the vicinity of the surface of the aluminum plate can be removed.

Electrochemical graining treatment easily forms fine pits at the surface of the aluminum plate and is therefore suitable to prepare a lithographic printing plate having excellent printability.

Electrochemical graining treatment is performed using direct or alternating current in an aqueous solution containing nitric acid or hydrochloric acid as its main ingredient.

Electrochemical graining treatment is preferably followed by chemical etching treatment described below. Smut and intermetallic compounds are present at the surface of the aluminum plate having undergone electrochemical graining treatment. In chemical etching treatment following electrochemical graining treatment, it is preferable for chemical etching using an alkali solution (alkali etching treatment) to be first performed in order to particularly remove smut with high efficiency. The conditions in chemical etching treatment using an alkali solution preferably include a treatment temperature of 20 to 80° C. and a treatment time of 1 to 60 seconds. It is desirable for the alkali solution to contain aluminum ions.

In order to remove substances generated by chemical etching treatment using an alkali solution following electrochemical graining treatment, it is further preferable to perform chemical etching treatment using an acid solution at a low temperature (desmutting treatment).

Even in cases where electrochemical graining treatment is not followed by alkali etching treatment, desmutting treatment is preferably performed to remove smut efficiently.

In the practice of the invention, chemical etching treatment is not particularly limited and may be performed by immersion, showering, coating or other process.

[First Anodizing Treatment Step]

The first anodizing treatment step is a step in which an anodized aluminum film having micropores which extend in the depth direction (thickness direction) of the film is formed at the surface of the aluminum plate by performing anodizing treatment with direct current or alternating current on the aluminum plate or the aluminum plate having undergone the above-described surface roughening treatment.

(Treatment Conditions)

A first electrolytic solution with a temperature (solution temperature) of up to 45° C. is used in the first anodizing treatment. Use of the electrolytic solution enables manufacture of a lithographic printing plate support which can provide a lithographic printing plate with a longer press life and more excellent deinking ability in continued printing and after suspended printing and a presensitized plate with excellent on-press developability.

The first electrolytic solution preferably has a temperature of 15 to 45° C. and more preferably 25 to 45° C. At a temperature within the foregoing range, the resulting lithographic printing plate and presensitized plate have more excellent properties. In cases where the first electrolytic solution has a temperature in excess of 45° C., the resulting lithographic printing plate has a short press life.

The first electrolytic solution preferably contains at least one electrolyte selected from the group consisting of sulfuric acid, phosphoric acid, chromic acid, oxalic acid, boric acid/sodium borate, sulfamic acid, benzenesulfonic acid and amidosulfonic acid, and sulfuric acid is more preferred in terms of more excellent effects of the invention.

The concentration of the electrolyte in the first electrolytic solution is not particularly limited and is preferably 10 to 170 g/L and more preferably 30 to 170 g/L in terms of more excellent effects of the invention.

The first electrolytic solution may contain aluminum ions. The content of the aluminum ions is not particularly limited and is preferably from 0.1 to 10 g/L and more preferably 1.0 to 8.0 g/L.

The solvent used for the first electrolytic solution is not particularly limited and water is preferably used. A water-insoluble solvent such as an organic solvent may be used as long as the effects of the invention are not impaired.

The first electrolytic solution may contain ingredients ordinarily present in the aluminum plate, electrodes, tap water, groundwater and the like. In addition, secondary and tertiary ingredients may be added. Here, "secondary and tertiary ingredients" includes, for example, the ions of metals such as sodium, potassium, magnesium, lithium, calcium, titanium, aluminum, vanadium, chromium, manganese, iron, cobalt, nickel, copper and zinc; cations such as ammonium ion; and anions such as nitrate ion, carbonate ion, chloride ion, phosphate ion, fluoride ion, sulfite ion, titanate ion, silicate ion and borate ion. These may be present in concentrations of about 0 to 10,000 ppm.

The current density in the first anodizing treatment step differs depending on the type of electrolytic solution used, and is preferably 20 to 60 A/dm$^2$ and more preferably 30 to 50 A/dm$^2$ in terms of more excellent effects of the invention.

The treatment time in the first anodizing treatment step differs depending on the type of electrolytic solution used, and is preferably 0.1 to 10 seconds and more preferably 0.5 to 1.0 second in terms of more excellent effects of the invention.

The amount of electricity in the first anodizing treatment step differs depending on the type of electrolytic solution used, and is preferably 10 to 50 C/dm$^2$ and more preferably 20 to 30 C/dm$^2$ in terms of more excellent effects of the invention.

The voltage condition in the first anodizing treatment step differs depending on the type of electrolytic solution used, and is preferably 20 to 60 V and more preferably 30 to 45 V in terms of more excellent effects of the invention.

In the first anodizing treatment step, the voltage is preferably increased in a continuous manner in terms of more excellent effects of the invention. The continuous increase of the voltage is preferred in terms of the effects of the invention because solubility differences in the thickness direction occur in the first anodizing treatment step, leading to further increase in the micropore diameter after the first anodizing treatment step.

In particular, the change in voltage per unit time is preferably from 20 to 200 V/s and more preferably from 70 to 90 V/s. At a voltage change within the above-defined range, a presensitized plate can be manufactured which exhibits excellent on-press developability and which enables a lithographic printing plate formed therefrom to have a long press life and excellent deinking ability in continued printing and after suspended printing.

The first anodizing treatment step is preferably performed under the following conditions: main ingredient of the electrolytic solution (aqueous solution): sulfuric acid; its concentration: 1 to 170 g/L; and current density: 20 to 60 A/dm$^2$.

(Treatment Method)

The treatment method in the first anodizing treatment step is not particularly limited, and continuous anodizing treatment is preferably performed by a solution-mediated power feed system in which power is fed to the aluminum plate through the electrolytic solution. DC or AC is preferably applied to the aluminum plate in anodizing treatment in a sulfuric acid-containing electrolytic solution.

Electrodes formed of lead, iridium oxide, platinum or ferrite may be used for power feed to the aluminum plate. In particular, an electrode mainly formed of iridium oxide and an electrode formed by coating the substrate surface with iridium oxide are preferred. So-called valve metals such as titanium, tantalum, niobium and zirconium are preferably used for the substrate and of these valve metals, titanium and niobium are preferred. The valve metals have comparatively high electric resistance and therefore the substrate may be formed by cladding the surface of a core made of copper with any of the valve metals. In the case of cladding the surface of a core made of copper with a valve metal, the substrate may be assembled by cladding the core divided into segments corresponding to parts with the valve metal and combining the parts together.

(Film Properties)

The average diameter of the micropores formed in the first anodizing treatment step as measured at the surface of the anodized film (average aperture size) is preferably from 5 to 10 nm and more preferably 6 to 8 nm. At an average diameter within the foregoing range, the resulting lithographic printing plate and presensitized plate are more excellent in press life and other properties.

The average diameter of the micropores is determined as follows: The surface of the anodized film is observed by FE-SEM at a magnification of 150,000× to obtain four images, and in the resulting four images, the diameter of the micropores within an area of 400×600 nm$^2$ is measured and the average of the measurements is calculated.

The equivalent circle diameter is used if the aperture of the micropore is not circular. The "equivalent circle diameter" refers to a diameter of a circle assuming that the shape of an aperture is the circle having the same projected area as that of the aperture.

The micropores preferably have a depth of 10 to 65 nm and more preferably 15 to 30 nm. At a depth within the foregoing range, the resulting lithographic printing plate and presensitized plate are more excellent in press life and other properties.

The depth is determined by taking a cross-sectional image of the anodized film at a magnification of 150,000×, measuring the depth of at least 25 micropores, and calculating the average of the measurements.

The density of the micropores is not particularly limited and is preferably 100 to 3,000 micropores/μm$^2$, and more preferably 100 to 800 micropores/μm$^2$. At a density within the foregoing range, the resulting lithographic printing plate and presensitized plate are more excellent in press life and other properties.

The anodized film obtained by the first anodizing treatment step preferably has a thickness of 20 to 80 nm and more preferably 50 to 70 nm. The anodized film obtained by the first anodizing treatment step preferably has a coating weight of 0.05 to 0.21 g/m$^2$ and more preferably 0.10 to 0.18 g/m$^2$.

At a film thickness and a coating weight within the foregoing ranges, the resulting lithographic printing plate and presensitized plate are more excellent in press life and other properties.

[Second Anodizing Treatment Step]

The second anodizing treatment step is a step in which the aluminum plate having undergone the first anodizing treatment is further anodized to enlarge the apertures of the micropores. In other words, the second anodizing treatment step enlarges the average diameter of the micropores obtained in the first anodizing treatment and forms the above-described small-diameter portions, and the thus obtained micropores have shapes suitable to achieve the effects of the invention.

(Treatment Conditions)

A second electrolytic solution with a temperature (solution temperature) of 50 to 70° C. is used in the second anodizing treatment. Use of the electrolytic solution enables manufacture of a lithographic printing plate support which can provide a lithographic printing plate with a long press life and excellent deinking ability in continued printing and after suspended printing and a presensitized plate with excellent on-press developability.

The second electrolytic solution preferably has a temperature of 55 to 65° C. At a temperature within the foregoing range, the resulting lithographic printing plate and presensitized plate have more excellent properties. In cases where the second electrolytic solution has a temperature of less than 50° C., the resulting lithographic printing plate has a short press life. In cases where the second electrolytic solution has a temperature in excess of 70° C., the resulting lithographic printing plate has low deinking ability in continued printing and after suspended printing.

The temperature of the second electrolytic solution is preferably higher by at least 15° C. than that of the first electrolytic solution. If the relation between the temperature of the first electrolytic solution and that of the second electrolytic solution is met, the resulting lithographic printing plate and presensitized plate are more excellent in properties such as press life and deinking ability in continued printing.

The second electrolytic solution preferably contains at least one electrolyte selected from the group consisting of sulfuric acid, phosphoric acid, chromic acid, oxalic acid, boric acid/sodium borate, sulfamic acid, benzenesulfonic acid and amidosulfonic acid, and sulfuric acid is more preferred in terms of more excellent effects of the invention.

The concentration of the electrolyte in the second electrolytic solution is not particularly limited and is preferably 100 to 500 g/L and more preferably 150 to 300 g/L in terms of more excellent effects of the invention.

The second electrolytic solution may contain aluminum ions. The content of the aluminum ions is not particularly limited and is preferably from 0.1 to 10 g/L and more preferably 1.0 to 8.0 g/L.

The solvent used for the second electrolytic solution is not particularly limited and water is preferably used. A water-insoluble solvent such as an organic solvent may be used as long as the effects of the invention are not impaired.

As in the first electrolytic solution, the second electrolytic solution may contain ingredients ordinarily present in the aluminum plate, electrodes, tap water, groundwater and the like. In addition, the above-described secondary and tertiary ingredients may be added.

The current density in the second anodizing treatment step differs depending on the type of electrolytic solution used, and is preferably 10 to 80 A/dm$^2$ and more preferably 15 to 30 A/dm$^2$ in terms of more excellent effects of the invention.

The treatment time in the second anodizing treatment step differs depending on the type of electrolytic solution used, and is preferably 3 to 60 seconds and more preferably 10 to 20 seconds in terms of more excellent effects of the invention.

The amount of electricity in the second anodizing treatment step differs depending on the type of electrolytic solution used, and is preferably 200 to 600 C/dm$^2$ and more preferably 240 to 400 C/dm$^2$ in terms of more excellent effects of the invention.

The voltage condition in the second anodizing treatment step differs depending on the type of electrolytic solution used, and is preferably 10 to 30 V and more preferably 10 to 20 V in terms of more excellent effects of the invention.

In the second anodizing treatment step, the voltage is preferably constant in terms of more excellent effects of the invention, more specifically from the viewpoint that the photosensitive layer is prevented from entering the anodized film obtained in the second anodizing treatment step while minimizing the deterioration of the scumming resistance.

The second anodizing treatment step is preferably performed under the following conditions: main ingredient of the electrolytic solution: sulfuric acid; its concentration: 170 to 500 g/L; and current density: 10 to 80 A/dm$^2$.

The treatment method in the second anodizing treatment step is not particularly limited, and a conventionally known method may be used as in the first anodizing treatment step.

(Film Properties)

The average diameter of the micropores formed in the second anodizing treatment step as measured at the surface of the anodized film (average aperture size) corresponds to the surface layer average diameter of the above-described large-diameter portions 18 and is preferably within the above-defined numeric range.

The difference between the average diameter of the micropores obtained in the first anodizing treatment step as measured at the surface of the anodized film (first average micropore diameter) and the average diameter of the micropores obtained in the second anodizing treatment step as measured at the surface of the anodized film (second average micropore diameter) is preferably at least 3 nm, more preferably from 3 to 15 nm and even more preferably from 3 to 10 nm. At an average diameter within the foregoing range, the resulting lithographic printing plate and presensitized plate are more excellent in press life and other properties.

The density of the micropores is not particularly limited and is preferably the same as that of the micropores obtained in the first anodizing treatment step.

The anodized film obtained by the second anodizing treatment step preferably has a thickness of 900 to 2,000 nm and more preferably 900 to 1,200 nm. The anodized film obtained by the second anodizing treatment step preferably has a coating weight of 2.3 to 5.2 g/m$^2$ and more preferably 2.4 to 3.0 g/m$^2$.

At a film thickness and a coating weight within the foregoing ranges, the resulting lithographic printing plate and presensitized plate have more excellent properties and particularly higher scratch resistance.

In the case of performing the third anodizing treatment step to be described later, the total thickness of the anodized films obtained by the second and third anodizing treatment steps is preferably from 900 to 2,000 nm and more preferably from 900 to 1,200 nm.

The ratio between the thickness of the anodized film obtained in the first anodizing treatment step (first film thickness) and that of the anodized film obtained in the second anodizing treatment step (second film thickness) (first film thickness/second film thickness) is preferably from 0.02 to 0.085 and more preferably from 0.04 to 0.06. At a film thickness ratio within the foregoing range, the resulting lithographic printing plate and presensitized plate have more excellent properties and particularly a longer press life.

In the case of performing the third anodizing treatment step to be described later, the ratio between the thickness of the anodized film obtained in the first anodizing treatment step (first film thickness) and the total thickness of the anodized films obtained in the second and third anodizing treatment steps (total thickness of the second and third films) (first film thickness/second film thickness+third film thickness) is preferably within the above-defined range.

In order to obtain the shape of the small-diameter portions 20*a* described above, during the treatment in the second anodizing treatment step (particularly during the second half of the treatment), the voltage to be applied may be increased stepwise or continuously or the temperature of the electrolytic solution may be decreased. This treatment enables the pores formed to have larger diameters thereby obtaining such a shape as in the small-diameter portions 20*a* described above.

As a result of the treatment in the second anodizing treatment step, the thickness of the anodized film between the bottoms of the resulting small-diameter portions and the aluminum plate tends to increase. In cases where the anodized film between the bottoms of the small-diameter portions and the aluminum plate has a predetermined thickness as a result of the foregoing treatment, the third anodizing treatment step to be described later may not be performed.

As long as the effects of the invention are not impaired, another anodizing treatment may be performed under different conditions between the first anodizing treatment step and the second anodizing treatment step or after the second anodizing treatment step.

The first and second anodizing treatment steps are preferably performed in a continuous manner in terms of more excellent effects of the invention. In other words, another anodizing treatment step is preferably not included between the first anodizing treatment step and the second anodizing treatment step.

[Third Anodizing Treatment Step]

The third anodizing treatment step is a step in which the aluminum plate having undergone the second anodizing treatment is further anodized to mainly increase the thickness of the anodized film located between the bottoms of the small-diameter portions and the aluminum plate (thickness of the barrier layer). The thickness X shown in FIG. 1A reaches a predetermined value as a result of the third anodizing treatment step.

In cases where the micropores already have desired shapes at the end of the second anodizing treatment step, the third anodizing treatment step may not be performed as described above.

The conditions of the anodizing treatment in the third anodizing treatment step are set as appropriate for the electrolytic solution used. The treatment is usually performed at a higher voltage than that applied in the second anodizing treatment step or with an electrolytic solution having a lower temperature than that of the electrolytic solution used in the second anodizing treatment step.

The type of electrolytic solution used is not particularly limited and any of the above-described electrolytic solutions may be used. By using, for example, a boric acid-containing aqueous solution in the electrolytic cell, the thickness X can be efficiently increased without changing the shape of the small-diameter portions obtained in the second anodizing treatment step.

The anodized film obtained by the third anodizing treatment step usually has a coating weight of 0.1 to 2.0 $g/m^2$ and preferably 0.2 to 1.6 $g/m^2$. At a coating weight within the foregoing range, the lithographic printing plate obtained using the lithographic printing plate support formed by the foregoing steps has a long press life, excellent deinking ability in continued printing and after suspended printing, excellent resistance to spotting, and excellent resistance to formation of perfect circle-shaped white spots, and the presensitized plate has excellent on-press developability.

The micropores may further extend in the thickness direction of the anodized film as a result of the third anodizing treatment step.

[Hydrophilizing Treatment Step]

The method of manufacturing the lithographic printing plate support of the invention may have a hydrophilizing treatment step in which the aluminum plate is hydrophilized after the above-described third anodizing treatment step. Hydrophilizing treatment may be performed by any known method disclosed in paragraphs [0109] to [0114] of JP 2005-254638 A.

It is preferable to perform hydrophilizing treatment by a method in which the aluminum plate is immersed in an aqueous solution of an alkali metal silicate such as sodium silicate or potassium silicate, or is coated with a hydrophilic vinyl polymer or a hydrophilic compound so as to form a hydrophilic undercoat.

Hydrophilizing treatment with an aqueous solution of an alkali metal silicate such as sodium silicate or potassium silicate can be performed according to the processes and procedures described in U.S. Pat. No. 2,714,066 and U.S. Pat. No. 3,181,461.

Preferred Embodiment

On the other hand, in the present invention, the lithographic printing plate support is preferably obtained by subjecting the aluminum plate to the respective treatments described in Embodiment A in the order shown below. Rinsing with water is desirably performed between the respective treatments. However, in cases where a solution of the same composition is used in the two consecutive steps (treatments), rinsing with water may be omitted.

Embodiment A (1) Mechanical graining treatment;

(2) Chemical etching treatment in an aqueous alkali solution (first alkali etching treatment);

(3) Chemical etching treatment in an aqueous acid solution (first desmutting treatment);

(4) Electrochemical graining treatment in a nitric acid-based aqueous solution (first electrochemical graining treatment);

(5) Chemical etching treatment in an aqueous alkali solution (second alkali etching treatment);

(6) Chemical etching treatment in an aqueous acid solution (second desmutting treatment);

(7) Electrochemical graining treatment in a hydrochloric acid-based aqueous solution (second electrochemical graining treatment);

(8) Chemical etching treatment in an aqueous alkali solution (third alkali etching treatment);

(9) Chemical etching treatment in an aqueous acid solution (third desmutting treatment);

(10) Anodizing treatments (first to third anodizing treatments);

(11) Hydrophilizing treatment.

The mechanical graining treatment, electrochemical graining treatments, chemical etching treatments, anodizing treatments and hydrophilizing treatment in (1) to (11) described above may be performed by the same treatment methods under the same conditions as those described above, but the treatment methods and conditions to be described below are preferably used to perform these treatments.

Mechanical graining treatment is preferably performed by using a rotating nylon brush roll having a bristle diameter of 0.2 to 1.61 mm and a slurry supplied to the surface of the aluminum plate.

Known abrasives may be used and illustrative examples that may be preferably used include silica sand, quartz, aluminum hydroxide and a mixture thereof.

The slurry preferably has a specific gravity of 1.05 to 1.3. Use may be made of a technique that involves spraying of the slurry, a technique that involves the use of a wire brush, or a technique in which the surface shape of a textured mill roll is transferred to the aluminum plate.

The aqueous alkali solution that may be used in chemical etching treatment in the aqueous alkali solution has a concentration of preferably 1 to 30 wt % and may contain aluminum and/or alloying ingredients present in the aluminum alloy in an amount of 0 to 10 wt %.

An aqueous solution composed mainly of sodium hydroxide is preferably used for the aqueous alkali solution. Chemical etching is preferably performed at a solution temperature of room temperature to 95° C. for a period of 1 to 120 seconds.

After the end of etching treatment, removal of the treatment solution with nip rollers and rinsing by spraying with water are preferably performed in order to prevent the treatment solution from being carried into the subsequent step.

In the first alkali etching treatment, the aluminum plate is dissolved in an amount of preferably 0.5 to 30 g/m$^2$, more preferably 1.0 to 20 g/m$^2$, and even more preferably 3.0 to 15 g/m$^2$.

In the second alkali etching treatment, the aluminum plate is dissolved in an amount of preferably 0.001 to 30 g/m$^2$, more preferably 0.1 to 4 g/m$^2$, and even more preferably 0.2 to 1.5 g/m$^2$.

In the third alkali etching treatment, the aluminum plate is dissolved in an amount of preferably 0.001 to 30 g/m$^2$, more preferably 0.01 to 0.8 g/m$^2$, and even more preferably 0.02 to 0.3 g/m$^2$.

In chemical etching treatments in an aqueous acid solution (first to third desmutting treatments), phosphoric acid, nitric acid, sulfuric acid, chromic acid, hydrochloric acid or a mixed acid containing two or more thereof may be advantageously used.

The aqueous acid solution preferably has a concentration of 0.5 to 60 wt %.

Aluminum and/or alloying ingredients present in the aluminum alloy may dissolve in the aqueous acid solution in an amount of 0 to 5 wt %.

Chemical etching is preferably performed at a solution temperature of room temperature to 95° C. for a treatment time of 1 to 120 seconds. After the end of desmutting treatment, removal of the treatment solution with nip rollers and rinsing by spraying with water are preferably performed in order to prevent the treatment solution from being carried into the subsequent step.

The aqueous solution that may be used in electrochemical graining treatment is now described.

An aqueous solution which is used in conventional electrochemical graining treatment involving the use of direct current or alternating current may be employed for the nitric acid-based aqueous solution used in the first electrochemical graining treatment. The aqueous solution to be used may be prepared by adding to an aqueous solution having a nitric acid concentration of 1 to 100 g/L at least one nitrate compound containing nitrate ions, such as aluminum nitrate, sodium nitrate or ammonium nitrate, or at least one chloride compound containing chloride ions, such as aluminum chloride, sodium chloride or ammonium chloride in a range of 1 g/L to saturation.

Metals which are present in the aluminum alloy, such as iron, copper, manganese, nickel, titanium, magnesium and silicon may also be dissolved in the nitric acid-based aqueous solution.

More specifically, use is preferably made of a solution to which aluminum chloride or aluminum nitrate is added so that a 0.5 to 2 wt % aqueous solution of nitric acid may contain 3 to 50 g/L of aluminum ions.

The temperature is preferably from 10 to 90° C. and more preferably from 40 to 80° C.

An aqueous solution which is used in conventional electrochemical graining treatment involving the use of direct current or alternating current may be employed for the hydrochloric acid-based aqueous solution used in the second electrochemical graining treatment. The aqueous solution to be used may be prepared by adding to an aqueous solution having a hydrochloric acid concentration of 1 to 100 g/L at least one nitrate compound containing nitrate ions, such as aluminum nitrate, sodium nitrate or ammonium nitrate, or at least one chloride compound containing chloride ions, such as aluminum chloride, sodium chloride or ammonium chloride in a range of 1 g/L to saturation.

Metals which are present in the aluminum alloy, such as iron, copper, manganese, nickel, titanium, magnesium and silicon may also be dissolved in the hydrochloric acid-based aqueous solution.

More specifically, use is preferably made of a solution to which aluminum chloride or aluminum nitrate is added so that a 0.5 to 2 wt % aqueous solution of hydrochloric acid may contain 3 to 50 g/L of aluminum ions.

The temperature is preferably from 10 to 60° C. and more preferably from 20 to 50° C. Hypochlorous acid may be added to the aqueous solution.

A sinusoidal, square, trapezoidal or triangular waveform may be used as the waveform of the alternating current in electrochemical graining treatment. The frequency is preferably from 0.1 to 250 Hz.

Figure 2:
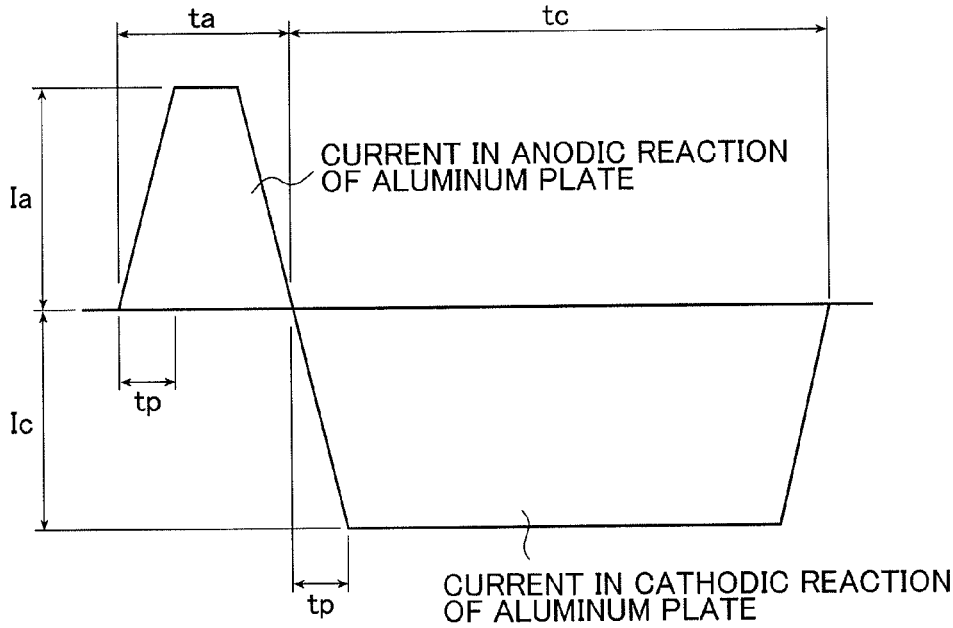
FIG. 2 is a graph showing an example of an alternating current waveform that may be used in electrochemical graining treatment in the method of manufacturing the lithographic printing plate support of the invention.

FIG. 2 is a graph showing an example of an alternating current waveform that may be used to perform electrochemical graining treatment in the method of manufacturing the lithographic printing plate support of the invention.

In FIG. 2, "ta" represents the anodic reaction time, "tc" the cathodic reaction time, "tp" the time required for the current to reach a peak from zero, "Ia" the peak current on the anode cycle side, and "Ic" the peak current on the cathode cycle side. In the trapezoidal waveform, it is preferable for the time tp until the current reaches a peak from zero to be from 1 to 10 ms. At a time tp of less than 1 ms under the influence of impedance in the power supply circuit, a large power supply voltage is required at the leading edge of the current pulse, thus increasing the power supply equipment costs. At a time tp of more than 10 ms, the aluminum plate tends to be affected by trace ingredients in the electrolytic solution, making it difficult to perform uniform graining. One cycle of alternating current that may be used in electrochemical graining treatment preferably satisfies the following conditions: the ratio of the cathodic reaction time tc to the anodic reaction time ta in the aluminum plate (tc/ta) is from 1 to 20; the ratio of the amount of electricity Qc when the aluminum plate serves as a cathode to the amount of electricity Qa when it serves as an anode (Qc/Qa) is from 0.3 to 20; and the anodic reaction time ta is from 5 to 1,000 ms. The ratio tc/ta is more preferably from 2.5 to 15. The ratio Qc/Qa is more preferably from 2.5 to 15. The current density at the current peak in the trapezoidal waveform is preferably from 10 to 200 A/dm$^2$ on both of the anode cycle side (Ia) and the cathode cycle side (Ic). The ratio Ic/Ia is preferably in a range of 0.3 to 20. The total amount of electricity furnished for the anodic reaction on the aluminum plate up until completion of electrochemical graining treatment is preferably from 25 to 1,000 C/dm$^2$.

In the practice of the invention, any known electrolytic cell employed for surface treatment, including vertical, flat and radial type electrolytic cells, may be used to perform electrochemical graining treatment using alternating current. Radial-type electrolytic cells such as those described in JP 5-195300 A are especially preferred.

Figure 3:
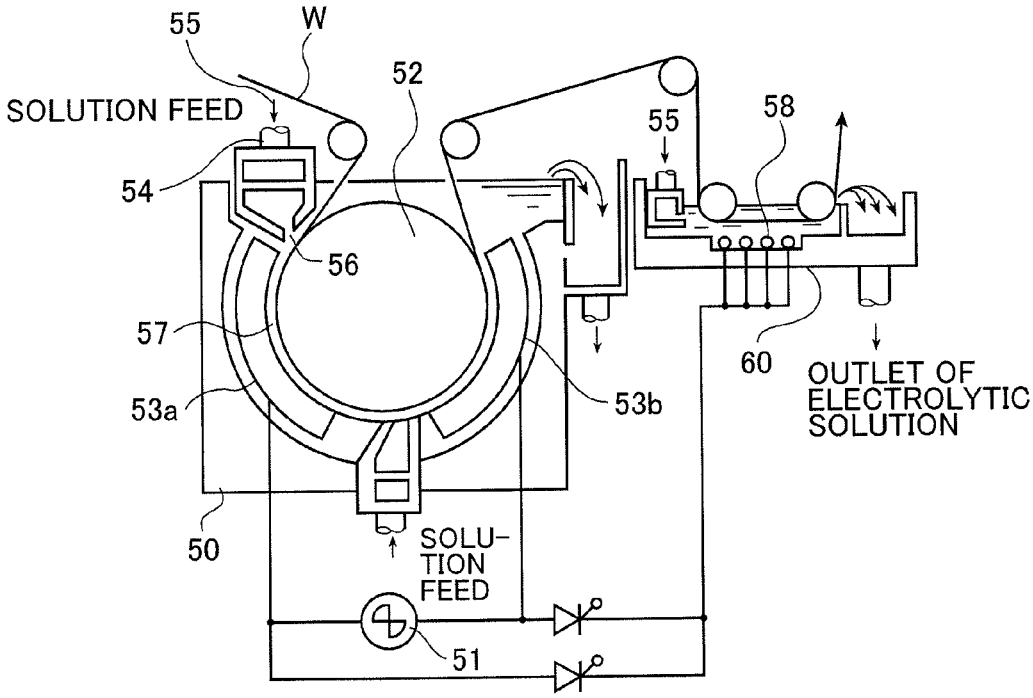
FIG. 3 is a side view showing an example of a radial cell in electrochemical graining treatment with alternating current in the method of manufacturing the lithographic printing plate support of the invention.

An apparatus shown in FIG. 3 may be used for electrochemical graining treatment using alternating current.

FIG. 3 is a side view of a radial electrolytic cell that may be used in electrochemical graining treatment with alternating current in the method of manufacturing the lithographic printing plate support of the invention.

FIG. 3 shows a main electrolytic cell 50, an AC power supply 51, a radial drum roller 52, main electrodes 53*a* and 53*b*, a solution feed inlet 54, an electrolytic solution 55, a slit 56, an electrolytic solution channel 57, auxiliary anodes 58, an auxiliary anode cell 60 and an aluminum plate W. When two or more electrolytic cells are used, electrolysis may be performed under the same or different conditions.

The aluminum plate W is wound around the radial drum roller 52 disposed so as to be immersed in the electrolytic solution within the main electrolytic cell 50 and is electrolyzed by the main electrodes 53*a* and 53*b* connected to the AC power supply 51 as it travels. The electrolytic solution 55 is fed from the solution feed inlet 54 through the slit 56 to the electrolytic solution channel 57 between the radial drum roller 52 and the main electrodes 53*a* and 53*b*. The aluminum plate W treated in the main electrolytic cell 50 is then electrolyzed in the auxiliary anode cell 60. In the auxiliary anode cell 60, the auxiliary anodes 58 are disposed in a face-to-face relationship with the aluminum plate W so that the electrolytic solution 55 flows through the space between the auxiliary anodes 58 and the aluminum plate W.

On the other hand, electrochemical graining treatment (first and second electrochemical graining treatments) may be performed by a method in which the aluminum plate is electrochemically grained by applying direct current between the aluminum plate and the electrodes opposed thereto.

(Drying Step)

After the lithographic printing plate support is obtained by the above-described steps, a treatment for drying the surface of the support (drying step) is preferably performed before providing an image recording layer to be described later thereon.

Drying is preferably performed after the support having undergone the final surface treatment is rinsed with water and the water removed with nip rollers. Specific conditions are not particularly limited but the surface of the lithographic printing plate support is preferably dried by hot air of 50° C. to 200° C. or natural air.

[Presensitized Plate]

The presensitized plate of the invention can be obtained by forming an image recording layer such as a photosensitive layer or a thermosensitive layer on the lithographic printing plate support of the invention. The type of the image recording layer is not particularly limited but conventional positive type, conventional negative type, photopolymer type, thermal positive type, thermal negative type and on-press developable non-treatment type as described in paragraphs [0042] to [0198] of JP 2003-1956 A are preferably used.

For example, the thermal positive type image recording layer of the presensitized plate may be of a single-layer type or a multi-layer type. The multi-layer type image recording layer is preferably of a two-layered structure. Specific examples of the single-layer type include those described in JP 2010-532488 A. Specific examples of the multi-layer type include those described in JP 2006-267294 A.

Specific examples of the photopolymer type image recording layer that may be advantageously used include those described in JP 2008-242046 A.

Specific examples of the thermal negative type image recording layer that may be advantageously used include those described in JP 2010-192645 A.

Specific examples of the on-press developable non-treatment type that may be advantageously used include those to be mentioned below and those described in JP 2009-502590 A and Japanese Patent Application No. 2010-294336.

The development process is not particularly limited and alkaline developers and developers to which a solvent is added are advantageously used. Developers described in US 2010/0216067 may also be advantageously used.

The image recording layer used for a presensitized plate in which the protective layer and unexposed part of the photosensitive layer can be removed at a time with a developer or a gum solution at a pH of 2 to 11 is also preferred. Typical image-forming embodiments include (1) an embodiment in which the image recording layer contains a sensitizing dye or an infrared absorber, a radical polymerization initiator and a radical polymerizable compound and image areas are cured by a polymerization reaction, and (2) an embodiment in which the image recording layer contains an infrared absorber and a particulate polymer, and thermal fusion or thermal reaction of the particulate polymer is used to form the hydrophobic regions (image areas). Such a particulate polymer is also called "hydrophobization precursor." Specific examples of the image recording layer include those described in JP 2003-255527 A, JP 2007-538279 A, JP 2009-258624 A, JP 2009-229944 A and JP 2010-156945 A.

Developers described in JP 2003-255527 A, JP 2007-538279 A, JP 2009-258624 A, JP 2009-229944 A, JP 2010-156945 A and JP 2011-017309 A may also be advantageously used for the developer or gum solution at a pH of 2 to 11.

A preferred image recording layer is described below in detail.

[Image Recording Layer]

An example of the image recording layer that may be preferably used in the presensitized plate of the invention includes one which can be removed by printing ink and/or fountain solution. More specifically, the image recording layer is preferably one which includes an infrared absorber, a polymerization initiator and a polymerizable compound and is capable of recording by exposure to infrared light.

In the presensitized plate of the invention, irradiation with infrared light cures exposed portions of the image recording layer to form hydrophobic (lipophilic) regions, while at the start of printing, unexposed portions are promptly removed from the support by fountain solution, ink, or an emulsion of ink and fountain solution.

The constituents of the image recording layer are described below.

(Infrared Absorber)

In cases where an image is formed on the presensitized plate of the invention using a laser emitting infrared light at 760 to 1,200 nm as a light source, an infrared absorber is usually used.

The infrared absorber has the function of converting absorbed infrared light into heat and the function of transferring electrons and energy to the polymerization initiator (radical generator) to be described below by excitation with infrared light.

The infrared absorber that may be used in the invention is a dye or pigment having an absorption maximum in a wavelength range of 760 to 1200 nm.

Dyes which may be used include commercial dyes and known dyes that are mentioned in the technical literature, such as Senryo Binran [Handbook of Dyes] (The Society of Synthetic Organic Chemistry, Japan, 1970).

Illustrative examples of suitable dyes include azo dyes, metal complex azo dyes, pyrazolone azo dyes, naphthoquinone dyes, anthraquinone dyes, phthalocyanine dyes, carbonium dyes, quinoneimine dyes, methine dyes, cyanine dyes, squarylium dyes, pyrylium salts and metal-thiolate complexes. In addition, cyanine dyes and indolenine cyanine dyes are preferred, and cyanine dyes of the general formula (a) below are particularly preferred.

General formula (a)

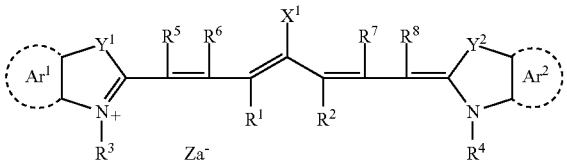

In general formula (a), $X^1$ is a hydrogen atom, a halogen atom, —$N(R^9)(R^{10})$, —$X^2$-$L^1$ or the following group. $R^9$ and $R^{10}$ may be the same or different and are each represent an aryl group containing 6 to 10 carbon atoms that may have a substituent, an alkyl group containing 1 to 8 carbon atoms that may have a substituent, or a hydrogen atom. $R^9$ and $R^{10}$ may be bonded together to form a ring. Of these, $R^9$ and $R^{10}$ are each preferably a phenyl group (—$NPh_2$). $X^2$ is an oxygen atom or a sulfur atom. $L^1$ is a hydrocarbon group containing 1 to 12 carbon atoms, a heteroaryl group or a hydrocarbon group containing 1 to 12 carbon atoms and having a heteroatom. Exemplary heteroatoms include nitrogen, sulfur, oxygen, halogen atoms and selenium. In the group shown below, $Xa^-$ is defined in the same way as $Za^-$ described below and $R^a$ is a substituent selected from among hydrogen atom, alkyl groups, aryl groups, substituted or unsubstituted amino groups and halogen atoms.

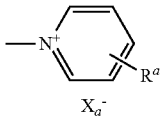

$R^1$ and $R^2$ are each independently a hydrocarbon group containing 1 to 12 carbon atoms. In terms of the storage stability of the image recording layer-forming coating fluid, $R^1$ and $R^2$ are each preferably a hydrocarbon group containing at least 2 carbon atoms. $R^1$ and $R^2$ may be bonded together to form a ring and the ring formed is most preferably a 5- or 6-membered ring.

$Ar^1$ and $Ar^2$ may be the same or different and are each an aryl group that may have a substituent. Preferred aryl groups include benzene and naphthalene rings. Preferred examples of the substituent include hydrocarbon groups containing up to 12 carbon atoms, halogen atoms, and alkoxy groups containing up to 12 carbon atoms. $Y^1$ and $Y^2$ may be the same or different and are each a sulfur atom or a dialkylmethylene group containing up to 12 carbon atoms. $R^3$ and $R^4$ may be the same or different and are each a hydrocarbon group containing up to 20 carbon atoms which may have a substituent. Preferred examples of the substituent include alkoxy groups containing up to 12 carbon atoms, carboxy group and sulfo group. $R^5$, $R^6$, $R^7$ and $R^8$ may be the same or different and are each a hydrogen atom or a hydrocarbon group containing up to 12 carbon atoms. In consideration of the availability of the starting materials, it is preferable for each of $R^5$ to $R^8$ to be a hydrogen atom. $Za^-$ represents a counteranion. In cases where the cyanine dye of the general formula (a) has an anionic substituent in the structure and there is no need for charge neutralization, $Za^-$ is unnecessary. For good storage stability of the image recording layer-forming coating fluid, preferred examples of $Za^-$ include halide ions, perchlorate ion, tetrafluoroborate ion, hexafluorophosphate ion and sulfonate ion. Of these, perchlorate ion, hexafluorophosphate ion and arylsulfonate ion are most preferred.

Specific examples of cyanine dyes of the general formula (a) that may be advantageously used include compounds described in paragraphs [0017] to [0019] of JP 2001-133969 A, paragraphs to [0021] of JP 2002-023360 A, and paragraphs [0012] to of JP 2002-040638 A, preferably compounds described in paragraphs [0034] to [0041] of JP 2002-278057 A and paragraphs to [0086] of JP 2008-195018 A, and most preferably compounds described in paragraphs [0035] to [0043] of JP 2007-90850 A. Compounds described in paragraphs [0008] to [0009] of JP 5-5005 A and paragraphs [0022] to [0025] of JP 2001-222101 A can also be preferably used.

These infrared absorbing dyes may be used alone or in combination of two or more thereof, or in combination with infrared absorbers other than the infrared absorbing dyes such as pigments. Exemplary pigments that may be preferably used include compounds described in paragraphs [0072] to [0076] of JP 2008-195018 A.

The content of the infrared absorbing dyes in the image recording layer of the invention is preferably from 0.1 to 10.0 wt % and more preferably from 0.5 to 5.0 wt % with respect to the total solids in the image recording layer.

(Polymerization Initiator)

Exemplary polymerization initiators which may be used are compounds that generate a radical under light or heat energy or both, and initiate or promote the polymerization of a compound having a polymerizable unsaturated group. In the invention, compounds that generate a radical under the action of heat (thermal radical generator) are preferably used.

Known thermal polymerization initiators, compounds having a bond with small bond dissociation energy and photopolymerization initiators may be used for the polymerization initiator.

For example, polymerization initiators described in paragraphs [0115] to [0141] of JP 2009-255434 A may be used.

Onium salts may be used for the polymerization initiator, and oxime ester compounds, diazonium salts, iodonium salts and sulfonium salts are preferred in terms of reactivity and stability.

These polymerization initiators may be added in a proportion, based on the total solids making up the image recording layer, of 0.1 to 50 wt %, preferably 0.5 to 30 wt %, and more preferably 1 to 20 wt %. An excellent sensitivity and a high resistance to scumming in non-image areas during printing are achieved at a polymerization initiator content within the above-defined range.

(Polymerizable Compound)

Polymerizable compounds are addition polymerizable compounds having at least one ethylenically unsaturated double bond, and are selected from compounds having at least one, and preferably two or more, terminal ethylenically unsaturated bonds. In the invention, use can be made of any addition polymerizable compound known in the prior art, without particular limitation.

For example, polymerizable compounds described in paragraphs [0142] to [0163] of JP 2009-255434 A may be used.

Urethane-type addition polymerizable compounds prepared using an addition reaction between an isocyanate group and a hydroxyl group are also suitable. Specific examples include the vinylurethane compounds having two or more polymerizable vinyl groups per molecule that are obtained by adding a hydroxyl group-bearing vinyl monomer of the general formula (A) below to the polyisocyanate compounds having two or more isocyanate groups per molecule mentioned in JP 48-41708 B.

$$CH_2{=}C(R^4)COOCH_2CH(R^5)OH \quad (A)$$

In the formula (A), $R^4$ and $R^5$ each independently represent H or $CH_3$.

The polymerizable compound is used in an amount of preferably 5 to 80 wt %, and more preferably 25 to 75 wt % with respect to the nonvolatile ingredients in the image recording layer. These addition polymerizable compounds may be used alone or in combination of two or more thereof.

(Binder Polymer)

In the practice of the invention, use may be made of a binder polymer in the image recording layer in order to improve the film forming properties of the image recording layer.

Conventionally known binder polymers may be used without any particular limitation and polymers having film forming properties are preferred. Examples of such binder polymers include acrylic resins, polyvinyl acetal resins, polyurethane resins, polyurea resins, polyimide resins, polyamide resins, epoxy resins, methacrylic resins, polystyrene resins, novolac phenolic resins, polyester resins, synthetic rubbers and natural rubbers.

Crosslinkability may be imparted to the binder polymer to enhance the film strength in image areas. To impart crosslinkability to the binder polymer, a crosslinkable functional group such as an ethylenically unsaturated bond may be introduced in the polymer main chain or side chain. The crosslinkable functional groups may be introduced by copolymerization.

Binder polymers disclosed in paragraphs [0165] to [0172] of JP 2009-255434 A may also be used.

The content of the binder polymer is from 5 to 90 wt %, preferably from 5 to 80 wt % and more preferably from 10 to 70 wt % based on the total solids of the image recording layer. A high strength in image areas and good image forming properties are achieved at a binder polymer content within the above-defined range.

The polymerizable compound and the binder polymer are preferably used in a weight ratio of 0.5/1 to 4/1.

(Surfactant)

A surfactant is preferably used in the image recording layer in order to promote the on-press developability at the start of printing and improve the coated surface state.

Exemplary surfactants include nonionic surfactants, anionic surfactants, cationic surfactants, amphoteric surfactants and fluorosurfactants.

For example, surfactants disclosed in paragraphs [0175] to [0179] of JP 2009-255434 A may be used.

The surfactants may be used alone or in combination of two or more thereof.

The content of the surfactant is preferably from 0.001 to 10 wt % and more preferably from 0.01 to 5 wt % based on the total solids in the image recording layer.

Various other compounds than those mentioned above may optionally be added to the image recording layer. For example, compounds disclosed in paragraphs [0181] to [0190] of JP 2009-255434 A such as colorants, printing-out agents, polymerization inhibitors, higher fatty acid derivatives, plasticizers, inorganic fine particles and low-molecular-weight hydrophilic compounds may be used.

[Formation of Image Recording Layer]

The image recording layer is formed by dispersing or dissolving the necessary ingredients described above in a solvent to prepare a coating fluid and applying the thus prepared coating fluid to the support. Examples of the solvent that may be used include, but are not limited to, ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate and water.

These solvents may be used alone or as mixtures of two or more thereof. The coating fluid has a solids concentration of preferably 1 to 50 wt %.

The image recording layer coating weight (solids content) on the support obtained after coating and drying varies with the intended use, although an amount of 0.3 to 3.0 g/m$^2$ is generally preferred. At an image recording layer coating weight within this range, a good sensitivity and good image recording layer film properties are obtained.

Examples of suitable methods of coating include bar coating, spin coating, spray coating, curtain coating, dip coating, air knife coating, blade coating and roll coating.

[Undercoat]

In the presensitized plate of the invention, it is desirable to provide an undercoat between the image recording layer and the lithographic printing plate support.

The undercoat preferably contains a polymer having a substrate adsorbable group, a polymerizable group and a hydrophilic group.

An example of the polymer having a substrate adsorbable group, a polymerizable group and a hydrophilic group includes an undercoating polymer resin obtained by copolymerizing an adsorbable group-bearing monomer, a hydrophilic group-bearing monomer and a polymerizable reactive group (crosslinkable group)-bearing monomer.

Monomers described in paragraphs [0197] to [0210] of JP 2009-255434 A may be used for the undercoating polymer resin.

Various known methods may be used to apply the undercoat-forming coating solution to the support. Examples of suitable methods of coating include bar coating, spin coating, spray coating, curtain coating, dip coating, air knife coating, blade coating and roll coating.

The coating weight (solids content) of the undercoat is preferably from 0.1 to 100 mg/m$^2$ and more preferably from 1 to 50 mg/m$^2$.

[Protective Layer]

In the presensitized plate of the invention, a protective layer may optionally be formed on the image recording layer to prevent scuffing and other damage to the image recording layer, to serve as an oxygen barrier, and to prevent ablation during exposure to a high-intensity laser.

The protective layer is described in detail in, for example, U.S. Pat. No. 3,458,311 and JP 55-49729 B.

Exemplary materials that may be used for the protective layer include those described in paragraphs [0213] to [0227] of JP 2009-255434 A (e.g., water-soluble polymer compounds and inorganic layered compounds).

The thus prepared protective layer-forming coating fluid is applied onto the image recording layer provided on the support and dried to form the protective layer. The coating solvent may be selected as appropriate in connection with the binder, but distilled water and purified water are preferably used in cases where a water-soluble polymer is employed. Examples of the coating method used to form the protective layer include, but are not limited to, blade coating, air knife coating, gravure coating, roll coating, spray coating, dip coating and bar coating.

The protective layer preferably has a coating weight after drying of 0.01 to 10 g/m$^2$, more preferably 0.02 to 3 g/m$^2$ and most preferably 0.02 to 1 g/m$^2$.

EXAMPLES

The invention is described below in detail by way of examples. However, the invention should not be construed as being limited to the following examples.

[Manufacture of Lithographic Printing Plate Support]

Aluminum alloy plates of material type 1S with a thickness of 0.3 mm were subjected to the treatments (a) to (m) to manufacture lithographic printing plate supports. Rinsing treatment was performed among all the treatment steps and the water remaining after rinsing treatment was removed with nip rollers.

(a) Mechanical Graining Treatment (Brush Graining)

Figure 4:
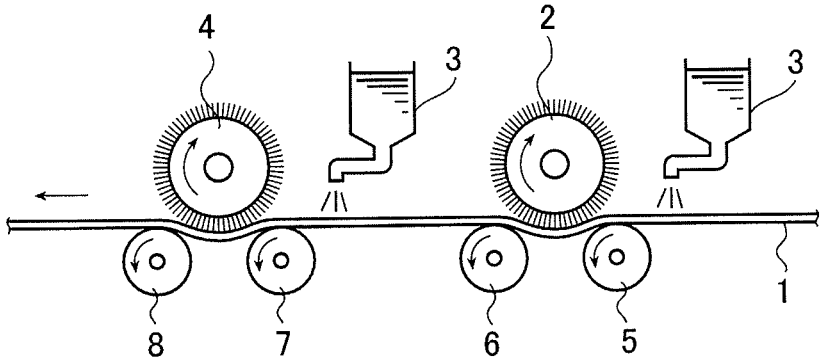
FIG. 4 is a schematic side view of the brush graining step used in mechanical graining treatment during manufacture of the lithographic printing plate support of the invention.

Mechanical graining treatment was performed with rotating bristle bundle brushes of an apparatus as shown in FIG. 4 while feeding an abrasive slurry in the form of a suspension of pumice having a specific gravity of 1.1 g/cm$^3$ to the surface of the aluminum plate. FIG. 4 shows an aluminum plate 1, roller-type brushes (bristle bundle brushes in Examples) 2 and 4, an abrasive slurry 3, and support rollers 5, 6, 7 and 8.

Mechanical graining treatment was performed using an abrasive having a median diameter of 30 μm while rotating four brushes at 250 rpm. The bristle bundle brushes were made of nylon 6/10 and had a bristle diameter of 0.3 mm and a bristle length of 50 mm. Each brush was constructed of a 300 mm diameter stainless steel cylinder in which holes had been formed and bristles densely set. Two support rollers (200 mm diameter) were provided below each bristle bundle brush and spaced 300 mm apart. The bundle bristle brushes were pressed against the aluminum plate until the load on the driving motor that rotates the brushes was greater by 10 kW than before the bundle bristle brushes were pressed against the plate. The direction in which the brushes were rotated was the same as the direction in which the aluminum plate was moved.

(b) Alkali Etching Treatment

Etching treatment was performed using a spray line to spray the aluminum plate obtained as described above with an aqueous solution having a sodium hydroxide concentration of 26 wt %, an aluminum ion concentration of 6.5 wt %, and a temperature of 70° C. The plate was then rinsed by spraying with water. The amount of dissolved aluminum was 10 g/m$^2$.

(c) Desmutting Treatment in Aqueous Acid Solution

Next, desmutting treatment was performed in an aqueous nitric acid solution. The nitric acid used in the subsequent electrochemical graining treatment step was used for the aqueous nitric acid solution in desmutting treatment. The solution temperature was 35° C. Desmutting treatment was performed by spraying the plate with the desmutting solution for 3 seconds.

(d) Electrochemical Graining Treatment

Electrochemical graining treatment was consecutively performed by nitric acid electrolysis using a 60 Hz AC voltage. Aluminum nitrate was added to an aqueous solution containing 10.4 g/L of nitric acid at a temperature of 35° C. to prepare an electrolytic solution having an adjusted aluminum ion concentration of 4.5 g/L, and the electrolytic solution was used in electrochemical graining treatment. Electrochemical graining treatment was performed for a period of time tp until the current reached a peak from zero of 0.8 ms, at a duty ratio of 1:1, using an alternating current having a trapezoidal waveform shown in FIG. 2, with a carbon electrode as the counter electrode. A ferrite was used for the auxiliary anodes. An electrolytic cell of the type shown in FIG. 3 was used. The current density at the current peak was 30 A/dm$^2$. Of the current that flows from the power supply, 5% was diverted to the auxiliary anodes. The amount of electricity (C/dm$^2$), which is the total amount of electricity when the aluminum plate serves as an anode, was 185 C/dm$^2$. The plate was then rinsed by spraying with water.

(e) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.5 g/m$^2$.

(f) Desmutting Treatment in Aqueous Acid Solution

Next, desmutting treatment was performed in an aqueous sulfuric acid solution. The aqueous sulfuric acid solution used in desmutting treatment was a solution having a sulfuric acid concentration of 170 g/L and an aluminum ion concentration of 5 g/L. The solution temperature was 60° C. Desmutting treatment was performed by spraying the plate with the desmutting solution for 3 seconds.

(g) Electrochemical Graining Treatment

Electrochemical graining treatment was consecutively performed by hydrochloric acid electrolysis using a 60 Hz AC voltage. Aluminum chloride was added to an aqueous solution containing 6.2 g/L of hydrochloric acid at a temperature of 35° C. to prepare an electrolytic solution having an adjusted aluminum ion concentration of 4.5 g/L, and the electrolytic solution was used in electrochemical graining treatment. Electrochemical graining treatment was performed for a period of time tp until the current reached a peak from zero of 0.8 ms, at a duty ratio of 1:1, using an alternating current having a trapezoidal waveform shown in FIG. 2, with a carbon electrode as the counter electrode. A ferrite was used for the auxiliary anodes. An electrolytic cell of the type shown in FIG. 3 was used. The current density at the current peak was 25 A/dm$^2$. The amount of electricity (C/dm$^2$) in hydrochloric acid electrolysis, which is the total amount of electricity when the aluminum plate serves as an anode, was 63 C/dm$^2$. The plate was then rinsed by spraying with water.

(h) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.1 g/m$^2$.

(i) Desmutting Treatment in Aqueous Acid Solution

Next, desmutting treatment was performed in an aqueous sulfuric acid solution. More specifically, an aqueous sulfuric acid solution for use in the anodizing treatment step (aqueous solution containing 170 g/L of sulfuric acid and 5 g/L of aluminum ions dissolved therein) was used to perform desmutting treatment at a solution temperature of 35° C. for 4 seconds. Desmutting treatment was performed by spraying the plate with the desmutting solution for 3 seconds.

(j) First Anodizing Treatment

Figure 5:
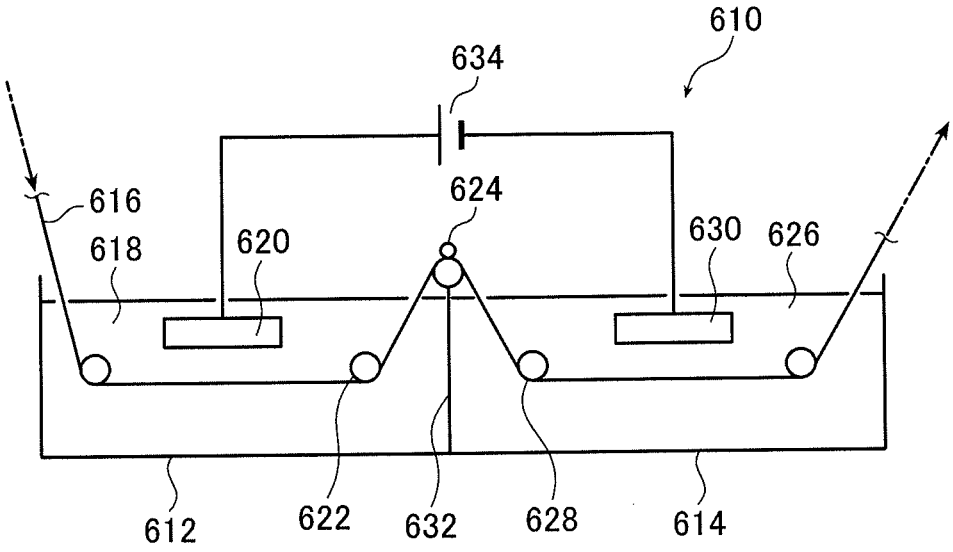
FIG. 5 is a schematic view of an anodizing apparatus that may be used in anodizing treatment during manufacture of the lithographic printing plate support of the invention.

The first anodizing treatment was performed using an anodizing apparatus of an indirect power feed electrolysis system as shown in FIG. 5. The anodizing treatment was performed under the conditions shown in Table 1 to form the anodized film with a specified film thickness. The electrolytic solution used is an aqueous solution containing the ingredients shown in Table 1.

In an anodizing apparatus 610, an aluminum plate 616 is transported as shown by arrows in FIG. 5. The aluminum plate 616 is positively (+) charged by a power supply electrode 620 in a power supply cell 612 containing an electrolytic solution 618. The aluminum plate 616 is then transported upward by a roller 622 disposed in the power supply cell 612, turned downward on a nip roller 624 and transported toward an electrolytic cell 614 containing an electrolytic solution 626 to be turned to a horizontal direction by a roller 628.

Then, the aluminum plate 616 is negatively (−) charged by an electrolytic electrode 630 to form an anodized film on the plate surface. The aluminum plate 616 emerging from the electrolytic cell 614 is then transported to the section for the subsequent step. In the anodizing apparatus 610, the roller 622, the nip roller 624 and the roller 628 constitute direction changing means, and the aluminum plate 616 is transported through the power supply cell 612 and the electrolytic cell 614 in a mountain shape and a reversed U shape by means of these rollers 622, 624 and 628. The power supply electrode 620 and the electrolytic electrode 630 are connected to a DC power supply 634.

(k) Second Anodizing Treatment

The second anodizing treatment was performed using an anodizing apparatus of an indirect power feed electrolysis system as shown in FIG. 5. The anodizing treatment was performed under the conditions shown in Table 1 to form the anodized film with a specified film thickness. The electrolytic solution used is an aqueous solution containing the ingredients shown in Table 1.

(l) Third Anodizing Treatment

The third anodizing treatment was performed using an anodizing apparatus of an indirect power feed electrolysis system as shown in FIG. 5. The anodizing treatment was performed under the conditions shown in Table 1 to form the anodized film with a specified film thickness. The electrolytic solution used is an aqueous solution containing the ingredients shown in Table 1.

(m) Silicate Treatment

In order to ensure the hydrophilicity in non-image areas, silicate treatment was performed by dipping the plate into an aqueous solution containing 2.5 wt % of No. 3 sodium silicate at 50° C. for 7 seconds. The amount of deposited silicon was 8.5 mg/m$^2$. The plate was then rinsed by spraying with water.

The average diameters at the anodized film surface and the communication position, of the large-diameter portions in the micropore-bearing anodized film obtained after the second anodizing treatment step (or the third anodizing treatment step) (surface layer average diameter and average bottom diameter), the average diameter at the communication position of the small-diameter portions (small-diameter portion diameter), the depths of the large-diameter portions and small-diameter portions, the ratio of the small-diameter portion diameter to the average bottom diameter, the density of micropores, and the thickness of the anodized film between the bottoms of the small-diameter portions and the surface of the aluminum plate (thickness of the barrier layer) are all shown in Table 2.

The average diameters of the micropores (surface layer average diameter and average bottom diameter of the large-diameter portions, and the average diameter of the small-diameter portions (small-diameter portion diameter)) are determined by observing the surface and the cross-sectional surface of the anodized film 14 by FE-TEM at a magnification of 500,000×, measuring the diameter of 60 (N=60) micropores and calculating the average of the measurements. The anodized film was optionally cut by FIB milling to form a thin film with a thickness of about 50 nm, and measurement was made on the cross-sectional surface of the anodized film 14.

The depths of the micropores (depth of the large-diameter portions and that of the small-diameter portions) are determined by observing the cross-sectional surface of the support (anodized film) (cross-sectional surface in the thickness direction) by FE-SEM at a magnification of 150,000× for the depth of the large-diameter portions and at a magnification of 50,000× for the small-diameter portions, measuring the depth of 25 micropores arbitrarily selected in the resulting image and calculating the average of the measurements.

The electrolytic solution used in each step is an aqueous solution containing the ingredients shown in Table 1. In Table 1, the term "concentration" refers to a concentration (g/L) of each ingredient shown in the column of "Solution."

In Comparative Example 12, pore-widening treatment described below was performed between the first anodizing treatment and the second anodizing treatment.

(Pore-Widening Treatment)

Pore-widening treatment was performed by immersing the anodized aluminum plate in an aqueous solution having a sodium hydroxide concentration of 5 wt %, an aluminum ion concentration of 0.5 wt %, and a temperature of 35° C. under the conditions shown in Table 1. The plate was then rinsed by spraying with water.

TABLE 1

| | First anodizing treatment | | | | | | Pore-widening treatment | | | | | Second anodizing treatment | | | | | | Third anodizing treatment | | | | | |
|---|---|---|---|---|---|---|---|---|---|---|---|---|---|---|---|---|---|---|---|---|---|---|---|
| | Solution type | Solution ingredient | Ingredient conc. (g/L) | Electrolyte temp. (°C.) | Current density (A/dm$^2$) | Film thickness (nm) | Solution type | Solution | Conc (wt %) | Temp. (° C.) | Time (s) | Solution type | Solution ingredient | Ingredient conc. (g/L) | Electrolyte temp. (° C.) | Current density (A/dm$^2$) | Film thickness (nm) | Solution type | Solution Ingredient | Ingredient conc. (g/L) | Electrolyte temp. (° C.) | Current density (A/dm$^2$) | Film thickness (nm) |
| EX 1 | Sulfuric acid | $H_2SO_4$/Al | 170/5 | 32 | 55 | 55 | — | — | — | — | — | Sulfuric acid | $H_2SO_4$/Al | 170/5 | 50 | 15 | 1000 | — | — | — | — | — | — |
| EX 2 | Sulfuric acid | $H_2SO_4$/Al | 170/5 | 32 | 55 | 55 | — | — | — | — | — | Sulfuric acid | $H_2SO_4$/Al | 170/5 | 60 | 15 | 1000 | — | — | — | — | — | — |
| EX 3 | Sulfuric acid | $H_2SO_4$/Al | 170/5 | 32 | 55 | 55 | — | — | — | — | — | Sulfuric acid | $H_2SO_4$/Al | 170/5 | 70 | 15 | 1000 | — | — | — | — | — | — |
| EX 4 | Sulfuric acid | $H_2SO_4$/Al | 170/5 | 32 | 55 | 55 | — | — | — | — | — | Sulfuric acid | $H_2SO_4$/Al | 170/5 | 50 | 15 | 900 | Sulfuric acid | $H_2SO_4$/Al | 170/5 | 40 | 15 | 100 |
| EX 5 | Sulfuric acid | $H_2SO_4$/Al | 170/5 | 32 | 55 | 55 | — | — | — | — | — | Sulfuric acid | $H_2SO_4$/Al | 170/5 | 60 | 15 | 900 | Sulfuric acid | $H_2SO_4$/Al | 170/5 | 40 | 15 | 100 |
| EX 6 | Sulfuric acid | $H_2SO_4$/Al | 170/5 | 32 | 55 | 55 | — | — | — | — | — | Sulfuric acid | $H_2SO_4$/Al | 170/5 | 70 | 15 | 900 | Sulfuric acid | $H_2SO_4$/Al | 170/5 | 40 | 15 | 100 |
| EX 7 | Sulfuric acid | $H_2SO_4$/Al | 170/5 | 32 | 55 | 55 | — | — | — | — | — | Sulfuric acid | $H_2SO_4$/Al | 300/5 | 50 | 15 | 900 | Sulfuric acid | $H_2SO_4$/Al | 170/5 | 40 | 15 | 100 |
| EX 8 | Sulfuric acid | $H_2SO_4$/Al | 170/5 | 32 | 55 | 55 | — | — | — | — | — | Sulfuric acid | $H_2SO_4$/Al | 300/5 | 60 | 15 | 900 | Sulfuric acid | $H_2SO_4$/Al | 170/5 | 40 | 15 | 100 |
| EX 9 | Sulfuric acid | $H_2SO_4$/Al | 170/5 | 32 | 55 | 55 | — | — | — | — | — | Sulfuric acid | $H_2SO_4$/Al | 300/5 | 70 | 15 | 900 | Sulfuric acid | $H_2SO_4$/Al | 170/5 | 40 | 15 | 100 |
| EX 10 | Sulfuric acid | $H_2SO_4$/Al | 170/5 | 32 | 55 | 55 | — | — | — | — | — | Sulfuric acid | $H_2SO_4$/Al | 170/5 | 60 | 15 | 450 | Sulfuric acid | $H_2SO_4$/Al | 170/5 | 40 | 15 | 450 |
| EX 11 | Sulfuric acid | $H_2SO_4$/Al | 170/5 | 40 | 55 | 55 | — | — | — | — | — | Sulfuric acid | $H_2SO_4$/Al | 170/5 | 60 | 15 | 900 | Sulfuric acid | $H_2SO_4$/Al | 170/5 | 40 | 15 | 100 |
| EX 12 | Sulfuric acid | $H_2SO_4$/Al | 170/5 | 40 | 15 | 55 | — | — | — | — | — | Sulfuric acid | $H_2SO_4$/Al | 170/5 | 60 | 15 | 900 | Sulfuric acid | $H_2SO_4$/Al | 170/5 | 40 | 15 | 100 |
| EX 13 | Sulfuric acid | $H_2SO_4$/Al | 230/5 | 32 | 55 | 55 | — | — | — | — | — | Sulfuric acid | $H_2SO_4$/Al | 170/5 | 60 | 15 | 900 | Sulfuric acid | $H_2SO_4$/Al | 170/5 | 40 | 15 | 100 |
| EX 14 | Sulfuric acid | $H_2SO_4$/Al | 170/5 | 32 | 55 | 10 | — | — | — | — | — | Sulfuric acid | $H_2SO_4$/Al | 170/5 | 60 | 15 | 900 | Sulfuric acid | $H_2SO_4$/Al | 170/5 | 40 | 15 | 100 |
| EX 15 | Sulfuric acid | $H_2SO_4$/Al | 170/5 | 32 | 55 | 75 | — | — | — | — | — | Sulfuric acid | $H_2SO_4$/Al | 170/5 | 60 | 15 | 900 | Sulfuric acid | $H_2SO_4$/Al | 170/5 | 40 | 15 | 100 |
| EX 16 | Phosphoric acid | $H_3PO_4$/Al | 10/5 | 10 | 2 | 55 | — | — | — | — | — | Sulfuric acid | $H_2SO_4$/Al | 170/5 | 60 | 15 | 900 | Sulfuric acid | $H_2SO_4$/Al | 170/5 | 40 | 15 | 100 |
| EX 17 | Phosphoric acid | $H_3PO_4$/Al | 10/5 | 10 | 10 | 55 | — | — | — | — | — | Sulfuric acid | $H_2SO_4$/Al | 170/5 | 60 | 15 | 900 | Sulfuric acid | $H_2SO_4$/Al | 170/5 | 40 | 15 | 100 |
| EX 18 | Sulfuric acid | $H_2SO_4$/Al | 230/5 | 32 | 30 | 55 | — | — | — | — | — | Sulfuric acid | $H_2SO_4$/Al | 300/5 | 60 | 15 | 900 | Sulfuric acid | $H_2SO_4$/Al | 170/5 | 40 | 15 | 100 |
| EX 19 | Sulfuric acid | $H_2SO_4$/Al | 230/5 | 32 | 30 | 50 | — | — | — | — | — | Sulfuric acid | $H_2SO_4$/Al | 300/5 | 60 | 15 | 900 | Sulfuric acid | $H_2SO_4$/Al | 170/5 | 40 | 15 | 100 |
| EX 20 | Sulfuric acid | $H_2SO_4$/Al | 170/5 | 32 | 55 | 55 | — | — | — | — | — | Sulfuric acid | $H_2SO_4$/Al | 100/5 | 50 | 15 | 1000 | — | — | — | — | — | — |

TABLE 1-continued

| | First anodizing treatment | | | | | | Pore-widening treatment | | | | | Second anodizing treatment | | | | | | Third anodizing treatment | | | | | |
|---|---|---|---|---|---|---|---|---|---|---|---|---|---|---|---|---|---|---|---|---|---|---|---|
| | Solution type | Solution ingredient | Ingredient conc. (g/L) | Electrolyte temp. (°C.) | Current density (A/dm$^2$) | Film thickness (nm) | Solution type | Solution | Conc (wt %) | Temp. (° C.) | Time (s) | Solution type | Solution ingredient | Ingredient conc. (g/L) | Electrolyte temp. (° C.) | Current density (A/dm$^2$) | Film thickness (nm) | Solution type | Solution Ingredient | Ingredient conc. (g/L) | Electrolyte temp. (° C.) | Current density (A/dm$^2$) | Film thickness (nm) |
| EX 21 | Sulfuric acid | $H_2SO_4$/Al | 170/5 | 32 | 55 | 55 | — | — | — | — | — | Sulfuric acid | $H_2SO_4$/Al | 500/5 | 70 | 10 | 900 | Sulfuric acid | $H_2SO_4$/Al | 170/5 | 40 | 15 | 100 |
| EX 22 | Sulfuric acid | $H_2SO_4$/Al | 170/5 | 32 | 55 | 55 | — | — | — | — | — | Sulfuric acid | $H_2SO_4$/Al | 170/5 | 60 | 15 | 1800 | Sulfuric acid | $H_2SO_4$/Al | 170/5 | 40 | 15 | 100 |
| EX 23 | Phosphoric acid | $H_3PO_4$/Al | 10/5 | 10 | 15 | 55 | — | — | — | — | — | Sulfuric acid | $H_2SO_4$/Al | 170/5 | 60 | 15 | 900 | Sulfuric acid | $H_2SO_4$/Al | 170/5 | 40 | 15 | 100 |
| CE 1 | Sulfuric acid | $H_2SO_4$/Al | 270/5 | 60 | 15 | 55 | — | — | — | — | — | Sulfuric acid | $H_2SO_4$/Al | 170/5 | 60 | 15 | 1000 | — | — | — | — | — | — |
| CE 2 | Sulfuric acid | $H_2SO_4$/Al | 170/5 | 32 | 55 | 290 | — | — | — | — | — | Sulfuric acid | $H_2SO_4$/Al | 170/5 | 60 | 15 | 1000 | — | — | — | — | — | — |
| CE 3 | Sulfuric acid | $H_2SO_4$/Al | 170/5 | 32 | 55 | 55 | — | — | — | — | — | Sulfuric acid | $H_2SO_4$/Al | 30/5 | 60 | 15 | 1000 | — | — | — | — | — | — |
| CE 4 | Sulfuric acid | $H_2SO_4$/Al | 170/5 | 32 | 55 | 500 | — | — | — | — | — | Sulfuric acid | $H_2SO_4$/Al | 170/5 | 60 | 15 | 500 | — | — | — | — | — | — |
| CE 5 | Sulfuric acid | $H_2SO_4$/Al | 330/5 | 40 | 15 | 55 | — | — | — | — | — | Sulfuric acid | $H_2SO_4$/Al | 500/5 | 70 | 10 | 900 | Sulfuric acid | $H_2SO_4$/Al | 170/5 | 40 | 15 | 100 |
| CE 6 | Phosphoric acid | $H_3PO_4$/Al | 10/5 | 10 | 2 | 55 | — | — | — | — | — | Sulfuric acid | $H_2SO_4$/Al | 170/5 | 60 | 15 | 1000 | — | — | — | — | — | — |
| CE 7 | Sulfuric acid | $H_2SO_4$/Al | 170/5 | 32 | 55 | 8 | — | — | — | — | — | Sulfuric acid | $H_2SO_4$/Al | 500/5 | 70 | 10 | 900 | Sulfuric acid | $H_2SO_4$/Al | 170/5 | 40 | 15 | 100 |
| CE 8 | Sulfuric acid | $H_2SO_4$/Al | 170/5 | 32 | 90 | 80 | — | — | — | — | — | Sulfuric acid | $H_2SO_4$/Al | 170/5 | 60 | 15 | 1000 | — | — | — | — | — | — |
| CE 9 | Sulfuric acid | $H_2SO_4$/Al | 170/5 | 32 | 55 | 170 | — | — | — | — | — | Sulfuric acid | $H_2SO_4$/Al | 170/5 | 60 | 15 | 1000 | — | — | — | — | — | — |
| CE 10 | Phosphoric acid | $H_3PO_4$/Al | 10/5 | 10 | 2 | 12 | — | — | — | — | — | Sulfuric acid | $H_2SO_4$/Al | 170/5 | 60 | 15 | 1000 | — | — | — | — | — | — |
| CE 11 | Sulfuric acid | $H_2SO_4$/Al | 250/5 | 32 | 55 | 55 | — | — | — | — | — | Sulfuric acid | $H_2SO_4$/Al | 170/5 | 60 | 15 | 1000 | — | — | — | — | — | — |
| CE 12 | Sulfuric acid | $H_2SO_4$/Al | 170/5 | 32 | 90 | 80 | Sodium hydroxide | NaOH/Al | 5/0.5 | 35 | 6 | Sulfuric acid | $H_2SO_4$/Al | 170/5 | 60 | 15 | 1000 | — | — | — | — | — | — |
| CE 13 | Sulfuric acid | $H_2SO_4$ | 170 | 30 | 5 | 308 | Immersion at 30° C. for 10 seconds in a solution containing 0.1M sodium hydrogen carbonate + 0.1M sodium carbonate and adjusted to a pH of 13 with NaOH | | | | | Sulfuric acid | $H_2SO_4$ | 170 | 30 | 5 | 846 | — | — | — | — | — | — |
| CE 14 | Phosphoric acid | $H_3PO_4$ | 50 | 30 | 1 | 346 | — | — | — | — | — | Sulfuric acid | $H_2SO_4$ | 170 | 30 | 1 | 654 | — | — | — | — | — | — |
| CE 15 | Oxalic acid | $(COOH)_2$ | 100 | 30 | 1 | 308 | — | — | — | — | — | Sulfuric acid | $H_2SO_4$ | 170 | 30 | 5 | 692 | — | — | — | — | — | — |
| CE 16 | Sulfuric | $H_2SO_4$ | 300 | 60 | 5 | 385 | — | — | — | — | — | Sulfuric | $H_2SO_4$ | 170 | 30 | 5 | 654 | — | — | — | — | — | — |

TABLE 1-continued

| | First anodizing treatment | | | | | | Pore-widening treatment | | | | | Second anodizing treatment | | | | | | Third anodizing treatment | | | | | |
|---|---|---|---|---|---|---|---|---|---|---|---|---|---|---|---|---|---|---|---|---|---|---|---|
| | Solution type | Solution ingredient | Ingredient conc. (g/L) | Electrolyte temp. (°C.) | Current density (A/dm$^2$) | Film thickness (nm) | Solution type | Solution | Conc (wt %) | Temp. (° C.) | Time (s) | Solution type | Solution ingredient | Ingredient conc. (g/L) | Electrolyte temp. (° C.) | Current density (A/dm$^2$) | Film thickness (nm) | Solution type | Solution Ingredient | Ingredient conc. (g/L) | Electrolyte temp. (° C.) | Current density (A/dm$^2$) | Film thickness (nm) |
| CE 17 | acid Sulfuric acid | $H_2SO_4$ | 50 | 10 | 20 | 385 | — | — | — | — | — | acid Sulfuric acid | $H_2SO_4$ | 170 | 30 | 5 | 654 | — | — | — | — | — | — |

TABLE 2

| | Micropore | | | | | | | | | |
|---|---|---|---|---|---|---|---|---|---|---|
| | Large-diameter portion | | | | | Small-diameter portion | | | | |
| | Surface layer average diameter (nm) | Average bottom diameter (nm) | Average bottom diameter − surface layer average diameter (nm) | Depth (nm) | Depth A/ average bottom diameter | Average diameter (nm) | Depth (nm) | Small-diameter portion diameter/ average bottom diameter | Micropore density (number of micropores/ $\mu m^2$) | Thickness of barrier layer (nm) |
| EX 1 | 12 | 25 | 13 | 45 | 1.80 | 14 | 980 | 0.56 | 500 | 18 |
| EX 2 | 14 | 25 | 11 | 45 | 1.80 | 14 | 980 | 0.56 | 500 | 16 |
| EX 3 | 16 | 25 | 9 | 45 | 1.80 | 14 | 980 | 0.56 | 500 | 14 |
| EX 4 | 12 | 25 | 13 | 45 | 1.80 | 4 | 980 | 0.16 | 500 | 24 |
| EX 5 | 14 | 25 | 11 | 45 | 1.80 | 14 | 980 | 0.56 | 500 | 24 |
| EX 6 | 16 | 25 | 9 | 45 | 1.80 | 12 | 980 | 0.48 | 500 | 24 |
| EX 7 | 14 | 23 | 9 | 45 | 1.96 | 10 | 980 | 0.43 | 500 | 24 |
| EX 8 | 14 | 23 | 9 | 45 | 1.96 | 9 | 980 | 0.39 | 500 | 24 |
| EX 9 | 13 | 23 | 10 | 45 | 1.96 | 8 | 980 | 0.35 | 550 | 24 |
| EX 10 | 14 | 25 | 11 | 45 | 1.80 | 14 | 980 | 0.56 | 620 | 24 |
| EX 11 | 13 | 21 | 8 | 45 | 2.14 | 14 | 980 | 0.67 | 570 | 24 |
| EX 12 | 12 | 19 | 7 | 45 | 2.37 | 14 | 980 | 0.74 | 640 | 24 |
| EX 13 | 11 | 18 | 7 | 45 | 2.50 | 14 | 980 | 0.78 | 720 | 24 |
| EX 14 | 14 | 25 | 11 | 7 | 0.28 | 14 | 980 | 0.56 | 100 | 24 |
| EX 15 | 14 | 25 | 11 | 55 | 2.20 | 14 | 980 | 0.56 | 500 | 24 |
| EX 16 | 48 | 58 | 10 | 38 | 0.66 | 14 | 980 | 0.24 | 50 | 24 |
| EX 17 | 38 | 48 | 10 | 38 | 0.79 | 14 | 980 | 0.29 | 80 | 24 |
| EX 18 | 10 | 12 | 2 | 45 | 3.75 | 9 | 980 | 0.75 | 840 | 24 |
| EX 19 | 10 | 12 | 2 | 40 | 3.33 | 9 | 980 | 0.75 | 840 | 24 |
| EX 20 | 12 | 25 | 13 | 45 | 1.80 | 19 | 980 | 0.76 | 500 | 18 |
| EX 21 | 12 | 25 | 13 | 45 | 1.80 | 5 | 980 | 0.20 | 500 | 28 |
| EX 22 | 12 | 25 | 13 | 45 | 1.80 | 14 | 1900 | 0.56 | 500 | 24 |
| EX 23 | 12 | 17 | 5 | 45 | 2.65 | 14 | 980 | 0.82 | 810 | 24 |
| CE 1 | 8 | 8 | 0 | 45 | 5.63 | 14 | 980 | 1.75 | 1200 | 17 |
| CE 2 | 12 | 25 | 13 | 280 | 11.20 | 14 | 980 | 0.56 | 500 | 17 |
| CE 3 | 12 | 25 | 13 | 45 | 1.80 | 21 | 980 | 0.84 | 500 | 19 |
| CE 4 | 15 | 25 | 10 | 480 | 19.20 | 14 | 480 | 0.56 | 500 | 17 |
| CE 5 | 8 | 9 | 1 | 45 | 5.00 | 5 | 980 | 0.56 | 700 | 20 |
| CE 6 | 50 | 63 | 13 | 45 | 0.71 | 14 | 980 | 0.22 | 30 | 17 |
| CE 7 | 7 | 12 | 5 | 3 | 0.25 | 5 | 980 | 0.42 | 800 | 20 |
| CE 8 | 12 | 25 | 13 | 70 | 2.80 | 14 | 980 | 0.56 | 500 | 17 |
| CE 9 | 12 | 25 | 13 | 150 | 6.00 | 14 | 980 | 0.56 | 500 | 17 |
| CE 10 | 16 | 25 | 9 | 2 | 0.08 | 14 | 980 | 0.56 | 50 | 17 |
| CE 11 | 9 | 16 | 7 | 45 | 2.81 | 14 | 980 | 0.88 | 820 | 17 |
| CE 12 | 25 | 25 | 0 | 70 | 2.80 | 14 | 980 | 0.88 | 500 | 17 |
| CE 13 | 17 | 17 | 0 | 268 | 15.76 | 8 | 836 | 0.47 | 3500 | 12 |
| CE 14 | 40 | 40 | 0 | 301 | 7.53 | 5 | 649 | 0.13 | 800 | 55 |
| CE 15 | 20 | 20 | 0 | 268 | 13.40 | 8 | 682 | 0.40 | 900 | 45 |
| CE 16 | 16 | 16 | 0 | 380 | 23.75 | 8 | 644 | 0.50 | 5000 | 5 |
| CE 17 | 15 | 15 | 0 | 345 | 23.00 | 8 | 644 | 0.53 | 25 | 40 |

In Examples 1 to 23, micropores having specified average diameters and depths were formed in the anodized aluminum film.

The manufacturing conditions in Comparative Examples 13 to 17 were the same as those in Examples 1 to 5 described in paragraph [0136] of JP 11-219657 A.

[Manufacture of Presensitized Plate]

An undercoat-forming coating solution of the composition indicated below was applied onto each lithographic printing plate support manufactured as described above to a coating weight after drying of 28 mg/$m^2$ to thereby form an undercoat.

(Undercoat-Forming Coating Solution)

| | |
|---|---|
| Undercoating compound (1) of the structure shown below | 0.18 g |
| Hydroxyethylimino diacetic acid | 0.10 g |
| Methanol | 55.24 g |
| Water | 6.15 g |

-continued

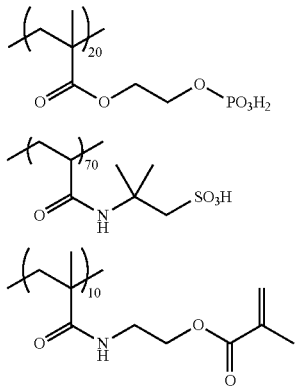

Undercoating compound (1)

Then, an image recording layer-forming coating fluid was applied onto the thus formed undercoat by bar coating and dried in an oven at 100° C. for 60 seconds to form an image recording layer having a coating weight after drying of 1.3 g/m$^2$.

The image recording layer-forming coating fluid was obtained by mixing with stirring the photosensitive solution and microgel fluid shown below just before use in application.

(Photosensitive Solution)

| | |
|---|---|
| Binder polymer (1) [its structure is shown below] | 0.24 g |
| Infrared absorber (1) [its structure is shown below] | 0.030 g |
| Radical polymerization initiator (1) [its structure is shown below] | 0.162 g |
| Polymerizable compound, tris(acryloyloxyethyl)isocyanurate (NK ester A-9300 available from Shin-Nakamura Chemical Corporation) | 0.192 g |
| Low-molecular-weight hydrophilic compound, tris(2-hydroxyethyl)isocyanurate | 0.062 g |
| Low-molecular-weight hydrophilic compound (1) [its structure is shown below] | 0.052 g |
| Sensitizer | 0.055 g |
| Phosphonium compound (1) [its structure is shown below] | |
| Sensitizer | 0.018 g |
| Benzyl-dimethyl-octyl ammonium•$PF_6$ salt | |
| Betaine derivative (C-1) [its structure is shown below] | 0.010 g |
| Fluorosurfactant (1) (weight-average molecular weight: 10,000) [its structure is shown below] | 0.008 g |
| Methyl ethyl ketone | 1.091 g |
| 1-Methoxy-2-propanol | 8.609 g |
| (Microgel Fluid) | |
| Micogel (1) | 2.640 g |
| Distilled water | 2.425 g |

The binder polymer (1), the infrared absorber (1), the radical polymerization initiator (1), the phosphonium compound (1), the low-molecular-weight hydrophilic compound (1), the betaine derivative (C-1) and the fluorosurfactant (1) have the structures represented by the following formulas:

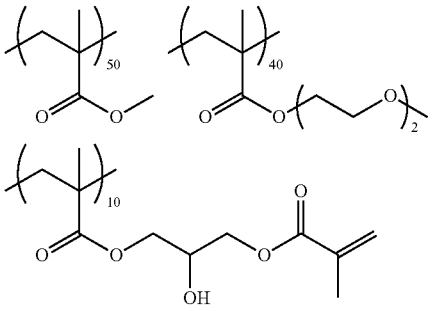

(Mw 70,000)

Binder polymer (1)

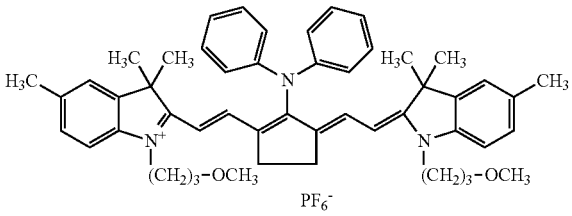

Infrared absorber (1)

-continued

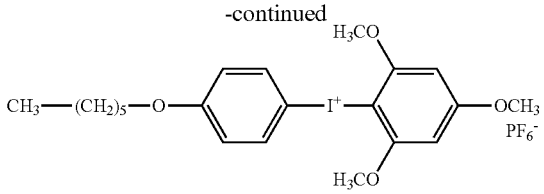

Polymerization Initiator (1)

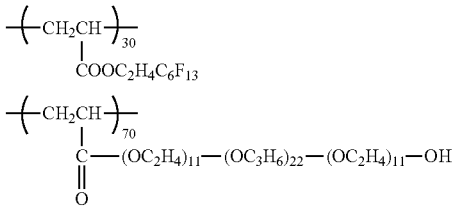

Fluorosurfactant (1)

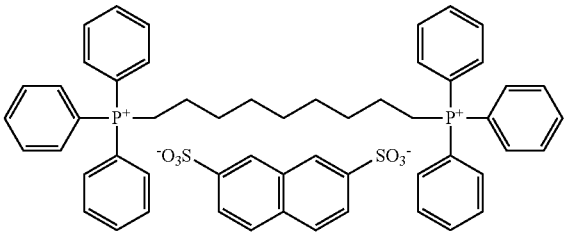

Phosphonium compound (1)

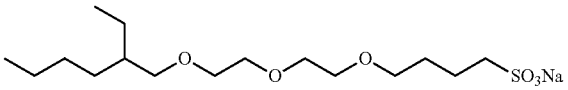

Low-molecular-weight hydrophilic compound (1)

(C-1)

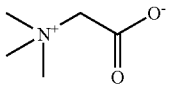

The microgel (1) was synthesized by the following procedure.

(Synthesis of Microgel (1))

For the oil phase component, 10 g of an adduct of trimethylolpropane with xylene diisocyanate (Takenate D-110N available from Mitsui Takeda Chemicals Inc.), 3.15 g of pentaerythritol triacrylate (SR444 available from Nippon Kayaku Co., Ltd.) and 0.1 g of Pionin A-41C (available from Takemoto Oil & Fat Co., Ltd.) were dissolved in 17 g of ethyl acetate. For the aqueous phase component, 40 g of a 4 wt % aqueous solution of PVA-205 was prepared. The oil phase component and the aqueous phase component were mixed and emulsified in a homogenizer at 12,000 rpm for 10 minutes. The resulting emulsion was added to 25 g of distilled water and the mixture was stirred at room temperature for 30 minutes, then at 50° C. for 3 hours. The thus obtained microgel fluid was diluted with distilled water so as to have a solids concentration of 15 wt % and used as the microgel (1). The average particle size of the microgel as measured by a light scattering method was 0.2 μm.

Then, a protective layer-forming coating fluid of the composition indicated below was applied onto the thus formed image recording layer by bar coating and dried in an oven at 120° C. for 60 seconds to form a protective layer having a coating weight after drying of 0.15 g/m$^2$, thereby obtaining a presensitized plate.

(Protective Layer-Forming Coating Fluid)

| | |
|---|---|
| Dispersion of an inorganic layered compound (1) | 1.5 g |
| 6 wt % Aqueous solution of polyvinyl alcohol (CKS50; modified with sulfonic acid; degree of saponification: at least 99 mol %; degree of polymerization: 300; available from Nippon Synthetic Chemical Industry Co., Ltd.) | 0.55 g |
| 6 wt % Aqueous solution of polyvinyl alcohol (PVA-405; degree of saponification: 81.5 mol %; degree of polymerization: 500; available from Kuraray Co., Ltd.) | 0.03 g |
| 1 wt % Aqueous solution of surfactant (EMALEX 710 available from Nihon Emulsion Co., Ltd.) | 8.60 g |
| Ion exchanged water | 6.0 g |

The dispersion of the inorganic layered compound (1) was prepared by the following procedure.

(Preparation of Dispersion of Inorganic Layered Compound (1))

To 193.6 g of ion exchanged water was added 6.4 g of synthetic mica Somasif ME-100 (available from Co-Op Chemical Co., Ltd.) and the mixture was dispersed in a homogenizer to an average particle size as measured by a laser scattering method of 3 μm. The resulting dispersed particles had an aspect ratio of at least 100.

[Evaluation of Presensitized Plate]

(On-Press Developability)

The resulting presensitized plate was exposed by Luxel PLATESETTER T-6000III from FUJIFILM Corporation equipped with an infrared semiconductor laser at an external drum rotation speed of 1,000 rpm, a laser power of 70% and a resolution of 2,400 dpi. The exposed image was set to contain a solid image and a 50% halftone chart of a 20 μm-dot FM screen.

The resulting presensitized plate after exposure was mounted without a development process on the plate cylinder of a Lithrone 26 press available from Komori Corporation. A fountain solution Ecality-2 (FUJIFILM Corporation)/tap water at a volume ratio of 2/98 and Values-G (N) black ink (Dainippon Ink & Chemicals, Inc.) were used. The fountain solution and the ink were supplied by the standard automatic printing start-up procedure on the Lithrone 26 to perform on-press development, and 100 impressions were printed on Tokubishi art paper (76.5 kg) at a printing speed of 10,000 impressions per hour.

The on-press developability was evaluated as the number of sheets of printing paper required to reach the state in which no ink is transferred to halftone non-image areas after the completion of the on-press development of the unexposed areas of the 50% halftone chart on the printing press. The on-press developability was rated "excellent" when the number of sheets was up to 20, "good" when the number of sheets was from 21 to 30, and "poor" when the number of sheets was 31 or more. The results are shown in Table 3.

(Press Life)

On-press development was performed on the same type of printing press by the same procedure as above and printing was further continued. The press life was evaluated by the number of impressions at the time when the decrease in density of a solid image became visually recognizable. The press life was rated "poor" when the number of impressions was less than 20,000, "fair" when the number of impressions was at least 20,000 but less than 25,000, "good" when the number of impressions was at least 25,000 but less than 35,000, and "excellent" when the number of impressions was 35,000 or more. The results are shown in Table 3.

(Deinking Ability after Suspended Printing)

Once good impressions were obtained after the end of the on-press development, printing was suspended and the printing plate was left to stand on the printing press for 1 hour in a room at a temperature of 25° C. and a humidity of 50%. Then, printing was resumed and the deinking ability after suspended printing was evaluated as the number of sheets of printing paper required to obtain a good unstained impression. The deinking ability after suspended printing was rated "excellent" when the number of wasted sheets was up to 75, "good" when the number of wasted sheets was 76 to 300, and "poor" when the number of wasted sheets was 301 or more. The results are shown in Table 3.

(Scratch Resistance)

The surface of the resulting lithographic printing plate support was subjected to a scratch test to evaluate the scratch resistance of the lithographic printing plate support.

The scratch test was performed using a continuous loading scratching intensity tester (SB-53 manufactured by Shinto Scientific Co., Ltd.) while moving a sapphire needle with a diameter of 0.4 mm at a moving velocity of 10 cm/s at a load of 100 g.

As a result, the support in which scratches due to the needle did not reach the surface of the aluminum alloy plate (base) was rated "good" as having excellent scratch resistance and the support in which scratches reached the plate surface was rated "poor." The lithographic printing plate support exhibiting excellent scratch resistance at a load of 100 g can suppress the transfer of scratches to the image recording layer when the presensitized plate prepared therefrom is mounted on the plate cylinder or superposed on another, thus reducing scumming in non-image areas. The results are shown in Table 3.

(Deinking Ability in Continued Printing)

Once good impressions were obtained after the end of the on-press development, varnish-added Fushion-EZ (S) ink (Dainippon Ink and Chemicals, Inc.) was applied to non-image areas of the lithographic printing plate. Then, printing was resumed and the deinking ability in continued printing was evaluated as the number of sheets of printing paper required to obtain a good unstained impression. The deinking ability in continued printing was rated "excellent" when the number of wasted sheets was up to 10, "good" when the number of wasted sheets was from 11 to 20, "fair" when the number of wasted sheets was from 21 to 30 and "poor" when the number of wasted sheets was 31 or more. The results are shown in Table 3.

TABLE 3

| | Press life | Deinking ability after suspended printing | Deinking ability in continued printing | On-press developability | Scratch resistance |
|---|---|---|---|---|---|
| EX 1 | Excellent | Excellent | Excellent | Good | Good |
| EX 2 | Excellent | Excellent | Excellent | Good | Good |
| EX 3 | Excellent | Good | Good | Excellent | Good |
| EX 4 | Excellent | Excellent | Excellent | Good | Good |
| EX 5 | Excellent | Excellent | Excellent | Good | Good |
| EX 6 | Excellent | Good | Good | Excellent | Good |
| EX 7 | Excellent | Excellent | Excellent | Good | Good |
| EX 8 | Excellent | Excellent | Excellent | Good | Good |
| EX 9 | Excellent | Good | Good | Excellent | Good |
| EX 10 | Excellent | Excellent | Excellent | Good | Good |
| EX 11 | Good | Excellent | Excellent | Good | Good |
| EX 12 | Good | Excellent | Excellent | Good | Good |
| EX 13 | Excellent | Excellent | Excellent | Good | Good |
| EX 14 | Good | Excellent | Excellent | Good | Good |
| EX 15 | Excellent | Excellent | Excellent | Good | Good |

TABLE 3-continued

| | Press life | Deinking ability after suspended printing | Deinking ability in continued printing | On-press developability | Scratch resistance |
|---|---|---|---|---|---|
| EX 16 | Excellent | Excellent | Excellent | Good | Good |
| EX 17 | Excellent | Excellent | Excellent | Good | Good |
| EX 18 | Good | Good | Good | Good | Good |
| EX 19 | Good | Good | Good | Good | Good |
| EX 20 | Excellent | Excellent | Excellent | Good | Good |
| EX 21 | Excellent | Excellent | Excellent | Good | Good |
| EX 22 | Excellent | Excellent | Excellent | Good | Good |
| EX 23 | Excellent | Good | Good | Good | Good |
| CE 1 | Poor | Good | Good | Good | Good |
| CE 2 | Excellent | Poor | Poor | Poor | Good |
| CE 3 | Excellent | Poor | Poor | Poor | Good |
| CE 4 | Excellent | Poor | Poor | Poor | Poor |
| CE 5 | Poor | Poor | Fair | Good | Good |
| CE 6 | Excellent | Poor | Fair | Poor | Good |
| CE 7 | Fair | Good | Good | Poor | Good |
| CE 8 | Excellent | Poor | Poor | Poor | Good |
| CE 9 | Excellent | Poor | Excellent | Poor | Good |
| CE 10 | Poor | Excellent | Excellent | Poor | Good |
| CE 11 | Fair | Poor | Poor | Poor | Good |
| CE 12 | Good | Poor | Poor | Poor | Good |
| CE 13 | Excellent | Poor | Poor | Poor | Poor |
| CE 14 | Excellent | Poor | Poor | Poor | Poor |
| CE 15 | Excellent | Poor | Poor | Poor | Poor |
| CE 16 | Excellent | Poor | Poor | Poor | Poor |
| CE 17 | Excellent | Poor | Poor | Poor | Poor |

Table 3 revealed that in the lithographic printing plates and presensitized plates in Examples 1 to 23 obtained using the lithographic printing plate supports each having an anodized aluminum film in which micropores having specified average diameters and depths were formed, the press life, deinking ability in continued printing and after suspended printing, on-press developability and scratch resistance were excellent. The large-diameter portions making up the micropores obtained in Examples 1 to 23 had such a substantially conical shape that the diameter increases from the surface of the anodized film toward the aluminum plate side (i.e., the average bottom diameter was larger than the surface layer average diameter). In Examples 1 to 3 and 20, the small-diameter portions had a substantially straight tubular shape. In Examples 4 to 19 and 21 to 23, the small-diameter portions each had a substantially tubular main pore portion and a substantially conical enlarged-diameter portion as shown in FIG. 1B. In Examples 4 to 19 and 21 to 23, the maximum diameter of the enlarged-diameter portions was larger by about 1 nm to about 8 nm than that of the main pore portions. In addition, in Examples 4 to 19 and 21 to 23, the main pore portions accounted for about 90% of the total depth of the small-diameter portions.

On the other hand, the results obtained in Comparative Examples 1 to 17 which do not meet the average diameters and the depths of the invention were inferior to those in Examples 1 to 23.

Particularly in Comparative Examples 13 to 17 in which Examples 1 to 5 specifically disclosed in JP 11-291657 A were reproduced, the deinking ability in continued printing and after suspended printing, on-press developability and scratch resistance were poor.

(Resistance to Spotting)

The resulting presensitized plate was conditioned with a slip sheet at 25° C. and 70% RH for 1 hour, wrapped with aluminum kraft paper and heated in an oven set at 60° C. for 10 days.

Then, the temperature was decreased to room temperature. On-press development was performed on the same type of printing press by the same procedure as above and 500 impressions were made. The 500th impression was visually checked and the number per 80 $cm^2$ of print stains with a size of at least 20 μm was counted.

The resistance to spotting was rated "poor" when the number of spots was 150 or more, "fair" when the number of spots was at least 100 but less than 150, "good" when the number of spots was at least 50 but less than 100, and "excellent" when the number of spots was less than 50.

The resistance to spotting is preferably not rated "poor" for practical use.

The presensitized plates obtained in Examples 4 to 19 and 21 were used to evaluate the resistance to spotting. The presensitized plates in Examples 4 to 19 were rated "good" and the presensitized plate in Example 21 was rated "excellent."

On the other hand, the presensitized plates obtained in Comparative Examples 15 and 18 were used to evaluate the resistance to spotting, and were rated "poor."

Examples 24 and Comparative Example 18

The aluminum supports having undergone the (k) second anodizing treatment in Examples 1 and Comparative Example 1 were subjected to silicate treatment described below. An undercoat and a recording layer were then formed in this order on the aluminum supports to obtain presensitized plates for use in Example 24 and Comparative Example 18.

(Silicate Treatment)

The aluminum supports obtained after the (k) second anodizing treatment in Example 1 and Comparative Example 1 were immersed for 10 seconds in a treatment bath containing 1 wt % aqueous solution of No. 3 sodium silicate at a temperature of 30° C. to perform alkali metal silicate treatment (silicate treatment). Then, the supports were washed by spraying with well water to obtain supports whose surfaces were hydrophilized by the silicate treatment. An undercoat liquid of the composition indicated below was applied onto the aluminum supports obtained as described above after the alkali metal silicate treatment and dried at 80° C. for 15 seconds to form an undercoat. The undercoat had a dry coating weight of 15 mg/$m^2$.

(Composition of Undercoat Liquid)

| | |
|---|---|
| Compound indicated below (weight-average molecular weight: 90,000) | 0.3 g |
| Methanol | 100 g |

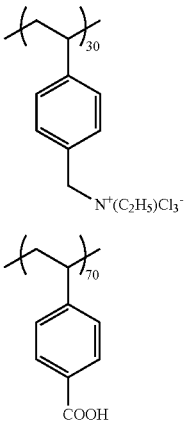

(Formation of Recording Layer (Multi-Layer))

A lower layer-forming coating liquid 1 of the composition indicated below was applied by bar coating to the undercoat on each of the supports obtained as above to a coating weight of 0.85 g/m$^2$ and dried at 142° C. for 50 seconds, and the supports were immediately cooled by cold air at 17 to 20° C. to a temperature of 35° C.

Then, an upper layer-forming coating liquid 1 of the composition indicated below was applied by bar coating to a coating weight of 0.22 g/m$^2$, dried at 130° C. for 60 seconds and further gradually cooled by air at 20 to 26° C. to obtain presensitized plates for use in Example 24 and Comparative Example 18.

(Lower Layer-Forming Coating Liquid 1)

| | |
|---|---|
| N-(4-aminosulfonylphenyl)methacrylamide/ acrylonitrile/methyl methacrylate (36/34/30: weight-average molecular weight: 50,000; acid value: 2.65) | 1.92 g |
| Novolac resin (ratio of m-cresol/p-cresol: 60/40; weight-average molecular weight: 5,500) | 0.192 g |
| Cyanine dye A (its structure is shown below) | 0.134 g |
| 4,4'-Bis(hydroxyphenyl)sulfone | 0.126 g |
| Tetrahydrophthalic anhydride | 0.190 g |
| p-Toluenesulfonic acid | 0.008 g |
| 3-Methoxy-4-diazo-diphenylamine hexafluorophosphate | 0.032 g |
| Dye obtained by changing counterion in Ethyl Violet to 6-hydroxynaphthalenesulfonic acid | 0.0781 g |
| Polymer (1) (its structure is shown below) | 0.035 g |
| Methyl ethyl ketone | 25.41 g |
| 1-Methoxy-2-propanol | 12.97 g |
| γ-Butyrolactone | 13.18 g |

Cyanin dye A

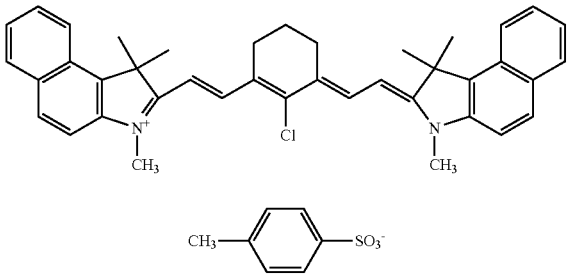

Polymer 1

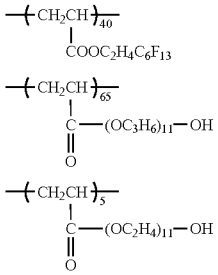

Mw: 20,000

(Upper Layer-Forming Coating Liquid 1)

| | |
|---|---|
| Phenol, m, p-cresol novolac (phenol/m/p ratio: 5/3/2; weight-average molecular weight: 4,500; unreacted cresol content: 0.8 wt %) | 0.3479 g |
| Polymer (3) (its structure is shown below; 30% MEK solution) | 0.1403 g |
| Cyanine dye A (its structure is shown above) | 0.0192 g |
| Polymer (1) (its structure is shown above) | 0.015 g |
| Sulfonium salt (its structure is shown below) | 0.006 g |

-continued

| | |
|---|---|
| Methyl ethyl ketone | 6.79 g |
| 1-Methoxy-2-propanol | 13.07 g |

Polymer 3

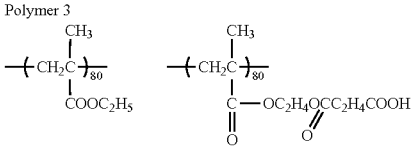

Mw: 60,000

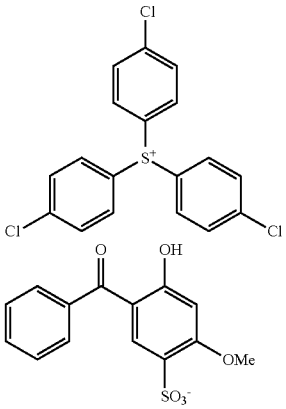

Sulfonium salt

A test pattern image (175 lpi, 50%) was formed on the resulting presensitized plates using Trendsetter (Creo) at a beam intensity of 9 W and a drum rotation speed of 150 rpm. The presensitized plates in Example 24 and Comparative Example 18 that were exposed under the above-described conditions were developed in a tray charged with a developer DT-2 (FUJIFILM Corporation) diluted with water (DT-2/water: 1/8) for a development time of 0 to 12 seconds while maintaining the liquid temperature at 30° C., thereby obtaining lithographic printing plates for use in Example 24 and Comparative Example 18.

Examples 25 and Comparative Example 19

The aluminum supports having undergone the (k) second anodizing treatment in Example 1 and Comparative Example 1 were immersed in an aqueous solution of polyvinyl phosphonic acid. An image recording layer of the composition indicated below was applied onto the aluminum supports taken out from the immersion bath and dried in an oven at 105° C. for 2.5 hours to obtain presensitized plates for use in Example 25 and Comparative Example 19. The image recording layer had a dry coating weight of 1.5 g/m$^2$.

(Image Recording Layer)

| | |
|---|---|
| Cresol novolac resin (Ruthapen 0744LB available from Bakelite AG) | 7.22 g |
| Crystal Violet (C.I. 42555; Basic Violet 3 (λmax: 588 nm)) | 0.2 g |
| Infrared absorber (S0094 available from FEW Chemicals GmbH; λmax: 813 nm) | 0.16 g |
| 1-(2-Hydroxyethyl)-2-pyrrolidone | 0.4 g |
| 1-Methoxy-2-propanol | 91.8 g |

The resulting presensitized plates were exposed by Lotem 400 Quantum imager (Creo) with an energy of 80 mJ/cm$^2$ and developed at 25° C. for 30 seconds with Goldstar Premium developer in a processor InterPlater 85HD (Glunz & Jensen)

to obtain lithographic printing plates for use in Example 24 and Comparative Example 18.

Examples 26 and Comparative Example 20

The aluminum supports having undergone the (k) second anodizing treatment in Example 1 and Comparative Example 1 were immersed for 10 seconds in a treatment solution of 0.4 wt % poly(acrylic acid) in pure water at 53° C. The moisture on the aluminum plates were completely removed in the drying step to prepare aluminum supports for use in Example 26 and Comparative Example 20.

An image recording layer-forming coating fluid of the composition indicated below was applied with a wire wound rod onto the aluminum supports and dried in a conveyor oven at 90° C. for a holding time of about 45 seconds to obtain presensitized plates for use in Example 26 and Comparative Example 20. The dry coating weight was 1.0 g/m$^2$.

(Image Recording Layer-Forming Coating Fluid)

| | |
|---|---|
| Polymer E described below | 1.93 parts by weight |
| Sartomer 399 (dipentylaerythritol pentaacrylate; Sartomer Company (Exton, Pennsylvania); 80 wt % 2-butanone solution) | 1.45 parts by weight |
| Graft copolymer (The graft polymer is a 24 wt % dispersion containing, in a mixture of n-propanol and water (80/20), Copolymer 9 described in paragraph [0138] of US 2004/0260050, the disclosure of which is incorporated herein by reference. The copolymer 9 was derived at a weight ratio of 10/9/81 from three monomers including poly(ethylene glycol)methyl ether methacrylate (average $M_n$: 2,080), styrene and acrylonitrile.) | 4.83 parts by weight |
| Irgacure 250 (iodonium(4-methylphenyl) [4-(2-methylpropyl)phenyl]hexafluorophosphate; Cibe Specialty Chemicals Inc.; 75 wt % propylene carbonate solution) | 0.30 part by weight |
| Infrared absorber I shown below | 0.19 part by weight |
| Mercapto-3-triazole | 0.13 part by weight |
| Byk 336 (modified dimethylpolysiloxane copolymer; Byk Chemie; 25 wt % xylene/ methoxypropyl acetate solution | 0.42 part by weight |
| Klucel M (hydroxypropyl cellulose thickener; Hercules; 1 wt % aqueous solution) | 4.63 parts by weight |
| ELVACITE 4026 (highly branched poly(methyl methacrylate); Ineos Acrylica, Inc.; 10 wt % 2-butanone solution) | 2.32 parts by weight |
| n-Propanol | 54.03 parts by weight |
| 2-Butanone | 15.97 parts by weight |
| Water | 13.81 parts by weight |

-continued

Infrared absorber I

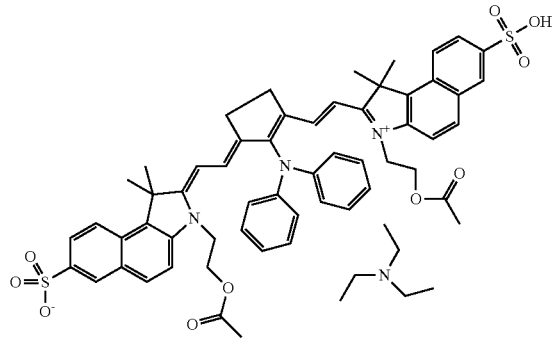

(Synthesis of Polymer E)

Methyl ethyl ketone (116.0 g), Desmodur (registered trademark) N100 (95.5 g, 0.5 eq), hydroxyethyl acrylate (30 g, 0.25 eq), pentaerythritol triacrylate (86.6 g, 0.21 eq, Viscoat-300 available from Osaka Chemical Co., Ltd., Japan) and hydroquinone (0.043 g) were introduced into a four-necked flask with a volume of 500 mL provided with a heating mantle, a temperature controller, a mechanical stirrer, a capacitor, and a nitrogen inlet. The mixture was stirred at room temperature for 10 minutes. The reaction mixture was then heated to 40° C. By the addition of dibutyltin dilaurate (0.14 g), the reaction mixture generated heat to reach 60° C. The NCO percentage as determined by titration after 2 hours was a stoichiometric value. The reaction mixture was cooled to 35° C. and dimethylacetamide (29.2 g) and p-aminobenzoic acid (6.86 g, 0.05 eq) were added. During the treatment, the reaction mixture was heated to 45° C. by the addition of two portions of butyltin dilaurate (0.8 g). The termination of the reaction was determined by the disappearance of an isocyanate infrared absorption band at 2275 cm$^{-1}$.

Examples 27 and Comparative Example 21

An image recording layer-forming coating liquid of the composition indicated below was applied onto the aluminum supports obtained in Example 1 and Comparative Example 1 to a wet thickness of 30 g/m$^2$ and dried to obtain presensitized plates for use in Example 27 and Comparative Example 21.

(Image Recording Layer-Forming Coating Fluid)

| | |
|---|---|
| Polystyrene particles (stabilized with an anionic wetting agent; average particle size: 70 nm) | 600 mg/m$^2$ |
| Dye I shown below (infrared absorbing dye) | 60 mg/m$^2$ |
| Polyacrylic acid (Glascol D15 available from Allied Colloids; molecular weight: 2.7 × 10$^7$ g/mol) | 120 mg/m$^2$ |
| Dye II shown below | 80 mg/m$^2$ |

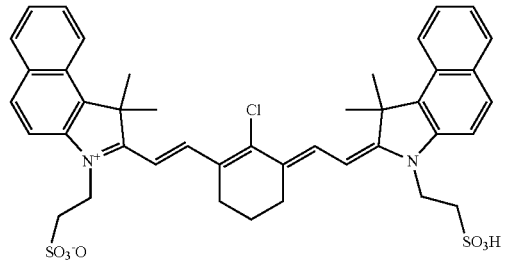

Dye I

-continued

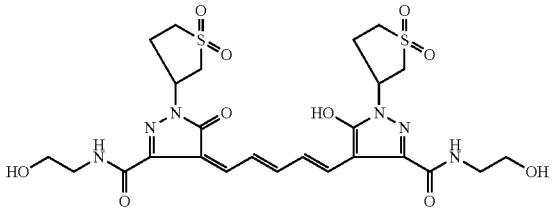

Dye II

The resulting presensitized plates were exposed using a platesetter Creo Trendsetter (CreoScitex, Burnaby, Canada; 330 mJ/cm$^2$; operated at 150 rpm). The exposed presensitized plates were developed with a developer of the composition indicated below in a processor HWP450 (Agfa-Gevaert N.V., Mortsel, Belgium) to obtain lithographic printing plates for use in Example 27 and Comparative Example 21. After the development, the lithographic printing plates were heated for 2 minutes in a furnace at a temperature of 270° C.

(Developer)

| | |
|---|---|
| Surfactant (DOWFAX3B2, Dow Chemical) | 77 mL/L |
| Citric acid | 10 g/L |
| Sodium citrate | 33 g/L |

(pH: 5.0; surface tension: 45 mN/m)

The lithographic printing plates were mounted on a printing press GTO46 (Heidelberger Druckmaschinen AG, Heidelberg, Germany). Printing was made using K&E800 ink and fountain solution containing 4% Combifix XL and 10% isopropanol.

Examples 28 and Comparative Example 22

The aluminum supports obtained after the (k) second anodizing treatment in Example 1 and Comparative Example 1 were immersed for 10 seconds in a treatment solution of 0.4 wt % polyvinyl phosphonic acid (PCAS) in pure water at 53° C. to remove extra treatment solution with nip rollers. Thereafter, the aluminum supports were washed for 4 seconds with well water at 60° C. containing 20 to 400 ppm of calcium ions and further washed for 4 seconds with pure water at 25° C. to remove extra pure water with nip rollers. The moisture on the aluminum plates was completely removed in the subsequent drying step to prepare aluminum supports for use in Example 28 and Comparative Example 22.

(Formation of Photosensitive Layer)

A photosensitive layer-forming coating fluid of the composition indicated below was applied with a bar onto the supports and dried in an oven at 90° C. for 60 seconds to form a photosensitive layer with a dry coating weight of 1.3 g/m$^2$.

(Photosensitive Layer-Forming Coating Fluid)

| | |
|---|---|
| Polymerizable compound (1) shown below | 3.6 g |
| Binder polymer (2) shown below (weight-average molecular weight: 47,000) | 2.4 g |
| Sensitizing dye (4) shown below | 0.32 g |
| Polymerization initiator (1) shown below | 0.61 g |
| Chain transfer agent (2) | 0.57 g |
| N-Nitrosophenylhydroxylamine aluminum salt | 0.020 g |
| ϵ-Phthalocyanine dispersion (pigment: 15 parts by weight; dispersant (allyl methacrylate/ methacrylic acid copolymer (weight-average molecular weight: 60,000; copolymer molar ratio: 83/17)): 10 parts by weight; cyclohexanone: 15 parts by weight) | 0.71 g |
| Fluorosurfactant (1) shown below (weight-average molecular weight: 10,000) | 0.016 g |
| Methyl ethyl ketone | 47 g |
| Propylene glycol monomethyl ether | 45 g |

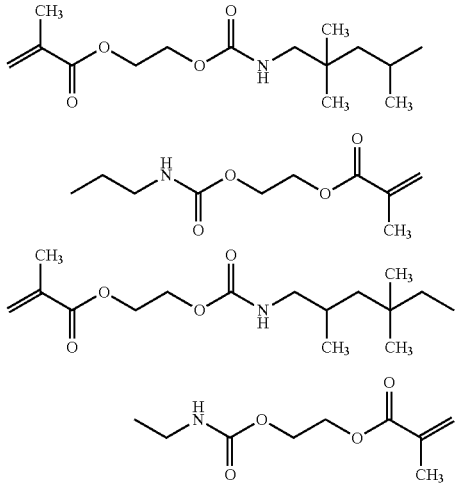

Polymerizable compound (1) (isomer compound)

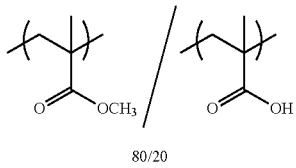

80/20

Binder polymer (2)

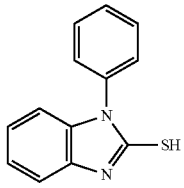

Chain transfer agent (2)

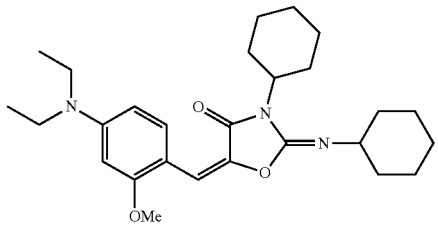

Sensitizing dye (4)

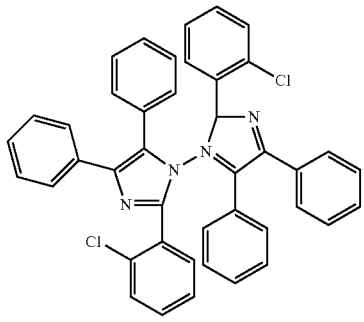

Polymerization initiator (1)

-continued

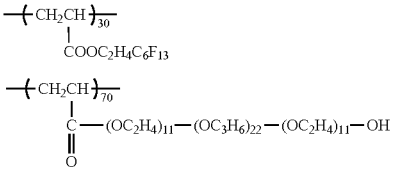

Fluorosurfactant (1)

(Formation of Protective Layer)

A protective layer-forming coating fluid of the composition indicated below was applied with a bar onto the supports having the photosensitive layer formed thereon and dried at 125° C. for 70 seconds to form a protective layer with a dry coating weight of 1.8 g/m$^2$, thus obtaining presensitized plates for use in Example 28 and Comparative Example 22.

(Protective Layer-Forming Coating Fluid)

| | |
|---|---|
| Mica dispersion described below | 0.6 g |
| Sulfonic acid-modified polyvinyl alcohol (Gohseran CKS-50 available from Nippon Synthetic Chemical Industry Co., Ltd. (degree of saponification: 99 mol %; average degree of polymerization: 300; degree of modification: about 0.4 mol %)) | 0.8 g |
| Poly(vinylpyrrolidone/vinyl acetate (1/1)) (molecular weight: 70,000) | 0.001 g |
| Surfactant (EMALEX 710 available from Nihon Emulsion Co., Ltd.) | 0.002 g |
| Water | 13 g |

(Mica Dispersion)

To 368 g of water was added 32 g of synthetic mica Somasif ME-100 (available from Co-Op Chemical Co., Ltd.; aspect ratio: at least 1,000) and the mixture was dispersed in a homogenizer to an average particle size as measured by a laser scattering method of 0.5 μm to obtain a mica dispersion.

(Exposure, Development and Printing)

The resulting presensitized plates were exposed imagewise by Platesetter Vx9600 (FUJIFILM Electronic Imaging Ltd.) equipped with a violet semiconductor laser (InGaN semiconductor laser with an emission wavelength of 405 nm±10 nm and an output power of 30 mW), and a 50% screen tint image was formed at a resolution of 2,438 dpi using an FM screen TAFFETA 20 (FUJIFILM Corporation). The amount of plate surface exposure was 0.05 mJ/cm$^2$.

Figure 6:
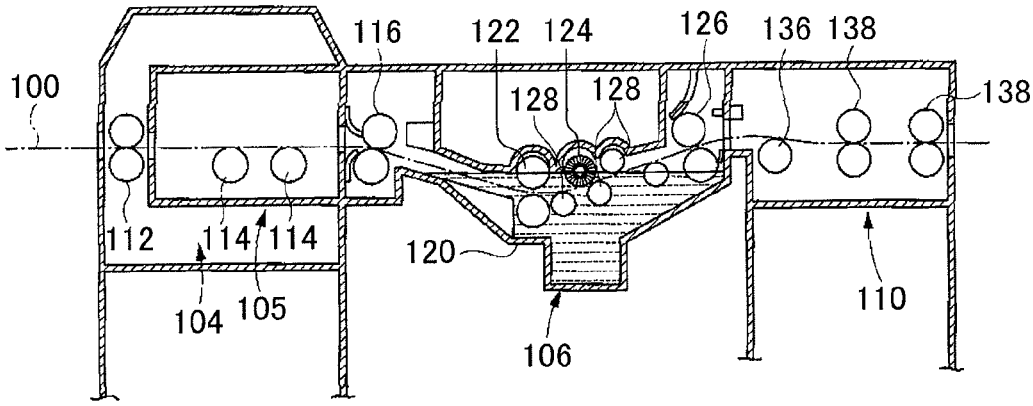
FIG. 6 is a schematic structural view of an automatic developing machine.

Then, a developer of the composition indicated below was used to perform development in an automatic developing machine of the structure shown in FIG. 6 at a preheating temperature of 100° C. for 10 seconds at such a transport speed that the time of immersion in the developer (development time) was 20 seconds, thereby obtaining lithographic printing plates for use in Example 28 and Comparative Example 22.

The automatic developing machine shown in FIG. 6 includes a pre-heating section 104 for heating the whole surface of a presensitized plate (hereinafter referred to as "PS plate") 100 to be developed, a developing section 106 for developing the PS plate 100, and a drying section 110 for drying the developed PS plate 100. The imagewise-exposed PS plate 100 is transported from an inlet through a transport roller pair 112 to a heating chamber 105, where the PS plate 100 is heated. The heating chamber 105 includes skewer-shaped rollers 114. The heating chamber 105 is also provided with a heating means such as a heat-generating means or a hot air supply means (not shown). Then, the PS plate 100 is transported through a transport roller pair 116 to the developing section 106. A developing bath 120 of the developing section 106 includes a transport roller pair 122, a brush roller 124 and a squeeze roller pair 126 disposed in this order from the upstream side in the transport direction, and backup rollers 128 are provided at suitable positions therebetween. The PS plate 100 is immersed in the developer as it is transported through the transport roller pair 122, and the brush roller 124 is rotated to remove non-image areas of the PS plate 100 to perform development. The developed PS plate 100 is transported through the squeeze roller pair (transport roller pair) 126 to the subsequent drying section 100.

The drying section 110 includes a guide roller 136 and skewer-shaped roller pairs 138 disposed in this order from the upstream side in the transport direction. The drying section 110 is also provided with a drying means such as a hot air supply means or a heat-generating means (not shown). The drying section 110 includes an outlet. The PS plate 100 dried by the drying means is discharged through the outlet and the automatic development process of the PS plate is completed.

(Developer)

| | |
|---|---|
| Surfactant-1 shown below (Softazoline LPB-R available from Kawaken Fine Chemicals Co., Ltd.) | 15 g |
| Surfactant-2 shown below (Softazoline LAO available from Kawaken Fine Chemicals Co., Ltd.) | 4 g |
| Chelating agent, trisodium ethylenediamine succinate (Octaquest E30 available from InnoSpec Specialty Chemicals.) | 0.68 g |
| 2-Bromo-2-nitropropane-1,3-diol | 0.025 g |
| 2-Methyl-4-isothiazolin-3-on | 0.025 g |
| Silicone antifoaming agent (TSA739 available from GE Toshiba Silicones Co., Ltd.) | 0.15 g |
| Sodium gluconate | 1.5 g |
| Sodium carbonate | 1.06 g |
| Sodium hydrogen carbonate | 0.52 g |
| Water | 77.04 g |
| The developer of the composition indicated above was adjusted with sodium hydroxide and phosphoric acid to a pH of 9.8. | |

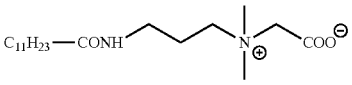

Softazoline LPB-R

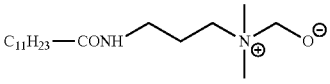

Softazoline LAO

Examples 29 and Comparative Example 23

The aluminum supports obtained after the (k) second anodizing treatment in Example 1 and Comparative Example 1 were surface-treated by immersing for 10 seconds in a surface treatment solution (40° C.) indicated below, washing with tap water at 20° C. for 2 seconds and drying at 100° C. for 10 seconds, whereby aluminum supports for use in Example 29 and Comparative Example 23 were prepared.

(Surface Treatment Solution)

| | |
|---|---|
| Polyvinyl phosphonic acid | 4 g |
| Tap water | 1,000 g |

A photosensitive layer-forming coating fluid 2 of the composition indicated below was applied with a bar onto the resulting aluminum supports and dried in an oven at 90° C. for 60 seconds to form a photosensitive layer with a dry coating weight of 1.3 g/m$^2$.

(Photosensitive Layer-Forming Coating Fluid 2)

| | |
|---|---|
| Binder polymer (1) shown below (weight-average molecular weight: 50,000) | 0.04 g |
| Binder polymer (2) shown below (weight-average molecular weight: 80,000) | 0.30 g |
| Polymerizable compound (1) (PLEX6661-O available from Degussa Japan Co., Ltd.) | 0.51 g |
| Polymerizable compound (2) shown below | 0.17 g |
| Sensitizing dye (1) shown below | 0.03 g |
| Sensitizing dye (2) shown below | 0.015 g |
| Sensitizing dye (3) shown below | 0.015 g |
| Polymerization initiator (1) shown above | 0.13 g |
| Chain transfer agent (mercaptobenzothiazole) | 0.01 g |
| ϵ-Phthalocyanine pigment dispersion (pigment: 15 parts by weight; dispersant (allyl methacrylate/ methacrylic acid copolymer (weight-average molecular weight: 60,000; copolymer molar ratio: 83/17)): 10 parts by weight; cyclohexanone: 15 parts by weight) | 0.40 g |
| Thermal polymeriazation inhibitor (N-Nitrosophenylhydroxylamine aluminum salt) | 0.01 g |
| Fluorosurfactant (1) shown above (weight-average molecular weight: 10,000) | 0.001 g |
| 1-Methoxy-2-propanol | 3.5 g |
| Methyl ethyl ketone | 8.0 g |

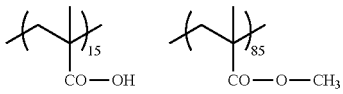

Binder polymer (1)

(Acid value: 85 mg KOH/g)

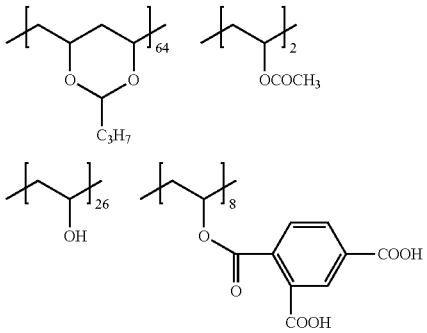

Binder poymer (2) (Acid value: 66 mg KOH/g)

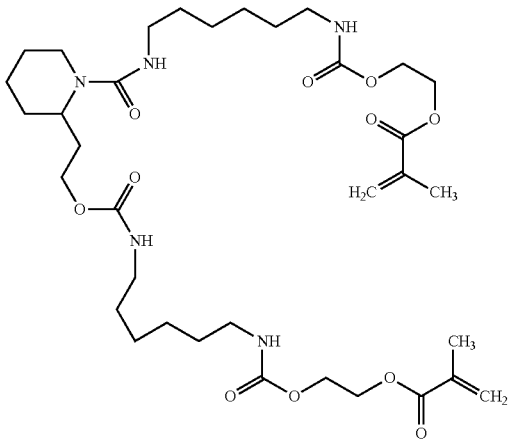

Polymerizable compound (2)

-continued

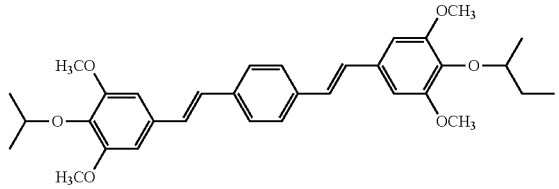

Senzitizing dye (1)

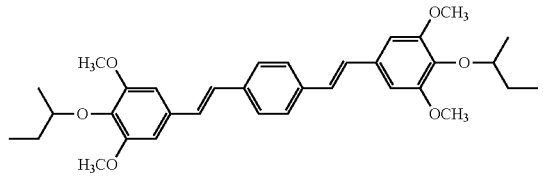

Sensitizing dye (2)

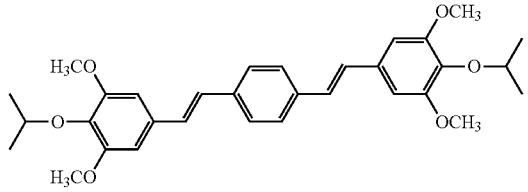

Sensitizing dye (3)

(Formation of Protective Layer)

A protective layer-forming coating fluid of the composition indicated below was applied with a bar onto the photosensitive layer formed in the above step and dried at 120° C. for 70 seconds to form a protective layer with a dry coating weight of 1.25 g/m$^2$, thus obtaining presensitized plates for use in Example 29 and Comparative Example 23.

(Protective Layer-Forming Coating Fluid)

| | |
|---|---|
| PVA-205 (partially-hydrolyzed polyvinyl alcohol available from Kuraray Co., Ltd. (degree of saponification: 86.5-89.5 mol %; viscosity: 4.6-5.4 mPa · s (20° C.; in 4 wt % aqueous solution)) | 0.658 g |
| PVA-105 (completely-hydrolyzed polyvinyl alcohol available from Kuraray Co., Ltd. (degree of saponification: 98.0-99.0 mol %; viscosity: 5.2-6.0 mPa · s (20° C.; in 4 wt % aqueous solution)) | 0.142 g |
| Poly(vinylpyrrolidone/vinyl acetate (1/1)) (molecular weight: 70,000) | 0.001 g |
| Surfactant (EMALEX 710 available from Nihon Emulsion Co., Ltd.) | 0.002 g |
| Water | 13 g |

(Exposure, Development and Printing)

The resulting presensitized plates were exposed imagewise by Platesetter Vx9600 (FFEI) equipped with a violet semiconductor laser (InGaN semiconductor laser with an emission wavelength of 405 nm±10 nm and an output power of 30 mW). Imagewise exposure was performed at a resolution of 2,438 dpi using an FM screen TAFFETA 20 (FUJIFILM Corporation) to form a 50% screen tint image. The amount of plate surface exposure was 0.05 mJ/cm$^2$.

Then, a developer of the composition indicated below was used to perform development in an automatic developing machine of the structure shown in FIG. 6. The pre-heating section had a temperature of 110° C. The developer had a temperature of 25° C. The presensitized plates were transported at a transport speed of 100 cm/min. The development was followed by drying in the drying section. The drying temperature was 80° C. After these treatments, lithographic printing plates for use in Example 29 and Comparative Example 23 were obtained.

[Developer]

| | |
|---|---|
| Propylene oxide-ethylene oxide block copolymer (PE9400 available from BASF) | 20.0 g |
| Surfactant (Emulsogen TS160 available from CLARIANT) | 0.30 g |
| Sodium gluconate | 0.75 g |
| 85% aqueous phosphoric acid solution | 5.88 g |
| Triethanolamine | 14.5 g |
| Water | 73.07 g |

(pH: 7.0)

Examples 30 and Comparative Example 24

To the aluminum supports obtained after the (k) second anodizing treatment in Example 1 and Comparative Example 1 was applied by bar coating an undercoat-forming coating liquid of the composition indicated below to a dry coating weight of 20 mg/m$^2$ and the coating liquid was dried at 150° C. for 5 seconds to form an undercoat on each of the supports.

(Undercoat-Forming Coating Liquid)

| | |
|---|---|
| Tetraethyl silicate | 4.0 parts by weight |
| Compound 1 shown below | 1.2 parts by weight |
| Compound 2 shown below | 11.0 parts by weight |
| Methanol | 5.0 parts by weight |
| Aqueous phosphoric acid solution (85%) | 2.5 parts by weight |

Compound 1

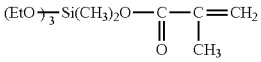

Compound 2

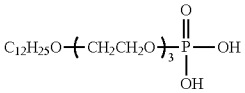

The above ingredients were mixed with stirring to cause heat generation in about 30 minutes. The mixture was reacted with stirring for 60 minutes and the undercoat-forming coating liquid was adjusted by the addition of the following ingredients:

| | |
|---|---|
| Methanol | 2,000 parts by weight |
| 1-Methoxy-2-propanol | 100 parts by weight |

(Preparation of Presensitized Plate)

A photosensitive layer-forming coating liquid (x) of the composition indicated below was applied by bar coating onto the prepared supports and then dried at 90° C. for 1 minute to form a photosensitive layer. The photosensitive layer-forming coating liquid (x) had a solids content of 8.2 wt %. The photosensitive layer had a dry coating weight of 1.35 g/m$^2$.

(Photosensitive Layer-Forming Coating Liquid (x))

| | |
|---|---|
| Polymerizable compound (PELEX6661-O available from DEGUSSA) | 1.69 parts by weight |
| Polymer binder (compound 3 shown below; weight-average molecular weight: 80,000) | 1.87 parts by weight |
| Sensitizing dye (illustrated compound D76) | 0.13 part by weight |
| Hexaarylbisimidazole photopolymerization initiator (BIMD available from Kurogane Kasei Co., Ltd.) | 0.46 part by weight |

-continued

| | |
|---|---|
| ϵ-Phthalocyanine pigment dispersion (pigment: 15 parts by weight; dispersant (allyl methacrylate/ methacrylic acid copolymer (weight-average molecular weight: 60,000; copolymer molar ratio: 83/17)): 10 parts by weight; cyclohexanone: 15 parts by weight) | 1.70 parts by weight |
| Mercapto compound (compound SH-1 shown below) | 0.34 part by weight |
| Nonionic fluorosurfactant (Megaface F-780F available from Dainippon Ink and Chemicals, Inc.) | 0.03 part by weight |
| Cupferron AL (polymerization inhibitor available from Wako Pure Chemical Industries, Ltd.) | |
| 10 wt % Solution of tricresyl phosphate | 0.12 part by weight |
| Methyl ethyl ketone | 27.0 parts by weight |
| Propylene glycol monomethyl ether | 26.7 parts by weight |

Compound 3

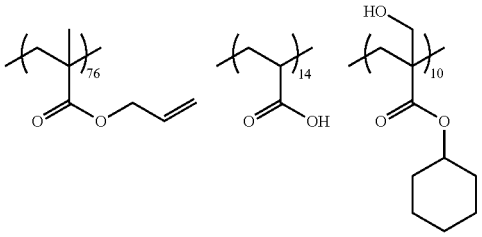

Illustrated compound D76

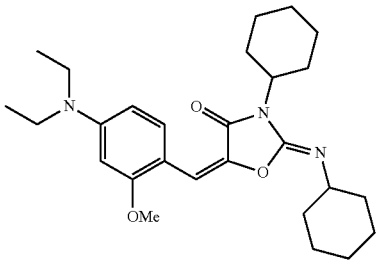

Compound SH-1

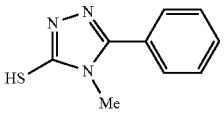

A protective layer-forming coating fluid (aqueous solution) of the composition indicated below was applied by bar coating onto the photosensitive layer to a dry coating weight of 2.5 g/m$^2$ and dried at 100° C. for 1 minute to obtain presensitized plates for use in Example 30 and Comparative Example 24. The protective layer-forming coating fluid had a solids content of 6.0 wt %.

(Protective Layer-Forming Coating Fluid)

| | |
|---|---|
| Polyvinyl alcohol (degree of saponification: 95 mol %; degree of polymerization: 500) | 162.0 parts by weight |
| Polyvinyl pyrrolidone (K-30 available from Wako Pure Chemical Industries, Ltd.) | 35.9 parts by weight |
| Luviskol VA64W (50% aqueous solution available from BASF) | 10.0 parts by weight |
| Nonionic surfactant (Pionin D230 available from Takemoto Oil & Fat Co., Ltd.) | 4.6 parts by weight |
| Nonionic surfactant (EMALEX 710 available from Nippon Nyukazai Co, Ltd.) | 3.7 parts by weight |

Each of the presensitized plates were cut into a size of a length of 700 mm and a width of 500 mm and mounted on Platesetter Vx9600 (FUJIFILM Electronic Imaging Ltd.)

equipped with a violet semiconductor laser (InGaN semiconductor laser with an emission wavelength of 405 nm±10 nm and an output power of 30 mW) to form a 35% screen tint image at an amount of exposure of 90 μJ/cm$^2$ and a resolution of 2,438 dpi using an FM screen TAFFETA 20 (FUJIFILM Corporation). The exposed plates were automatically sent to an automatic developing machine LP1250PLX connected to the platesetter and equipped with a brush. In the automatic developing machine, the plates were heated at 100° C. for 10 seconds and the protective layer was removed by washing with water. Subsequently, the plates were developed at 28° C. for 20 seconds. The developed plates were washed in a rinsing bath containing water and sent to a gumming bath. The gummed plates were dried with hot air and discharged, whereby lithographic printing plates for use in Example 30 and Comparative Example 24 which had a screen tint image formed thereon were obtained. The developer used was a developer DV-2 (FUJIFILM Corporation) diluted five times with water. The gum solution used was FP-2W (FUJIFILM Corporation) diluted twice with water.

Examples 31 and Comparative Example 25

Synthesis of Heterocycle-Containing Polymer Pigment Dispersant

Synthesis Example 1

Synthesis of Polymer No. 1

Into a nitrogen-purged three-necked flask were introduced 10.0 parts of M-11 (shown below), 75.0 parts of a terminal-methacryloylized polymethyl methacrylate [number-average molecular weight: 6,000: AA-6 available from Toagosei Co., Ltd.; abbreviated as MM-1], 15.0 parts of methacrylic acid and 334.0 parts of 1-methoxy-2-propanol. The mixture was stirred in an agitator (Three-One Motor available from Shinto Scientific Co., Ltd.) and heated to 90° C. as nitrogen was flowed through the flask.

To the mixture was added 0.5 part of 2,2-azobis(2,4-dimethylvaleronitrile) (V-65 available from Wako Pure Chemical Industries, Ltd.) and the mixture was heated with stirring at 90° C. for 2 hours. After 2 hours, 0.5 part of V-65 was further added. After heating with stirring for 3 hours, a 30% solution of graft polymer compound (Polymer No. 1) which had a MM-1-derived side chain on the main chain derived from methyl methacrylate and methacrylic acid was obtained.

The weight-average molecular weight of the resulting polymer compound (Polymer No. 1) as measured by gel permeation chromatography (GPC) using polystyrene as a standard substance was 20,000.

According to the titration using sodium hydroxide, the acid value per solids content was 98 mg KOH/g.

M-11

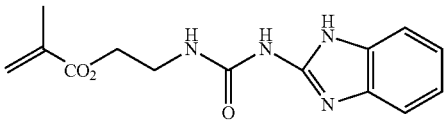

[Preparation of Pigment Dispersion]

To 15.0 parts of C.I. Pigment Blue 15:6 were added 7.5 parts of a dispersant (Polymer No. 1/AJISPER PB822:9/1 (weight ratio), 31.0 parts of methyl ethyl ketone, 15.5 parts of methanol and 31.0 parts of 1-methoxy-2-propanol (in total 100 parts). The mixture was dispersed for 30 minutes in DYNO-MILL to prepare a pigment dispersion.

The aluminum supports obtained after the (k) second anodizing treatment in Example 1 and Comparative Example 1 were surface-treated by applying an undercoat-forming coating liquid of the composition indicated below to a dry coating weight of 10 mg/m$^2$, thereby forming an undercoat on each of the supports.

(Undercoat-Forming Coating Liquid)

| | |
|---|---|
| Polymer compound A of the structure shown below (weight-average molecular weight: 30,000) | 0.017 part by weight |
| Methanol | 9.00 parts by weight |
| Water | 1.00 part by weight |

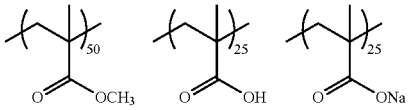

Polymer compound A

The numbers on the lower right side of parenthesis pairs each showing a monomer unit in the polymer compound A represent a molar ratio.

(Formation of Photosensitive Layer)

A photosensitive layer-forming coating liquid indicated below was prepared and applied with a wire bar onto the undercoat formed as described above. The photosensitive layer-forming coating liquid was dried in a hot air drying device at 125° C. for 34 seconds. The dry coating weight was 1.0 g/m$^2$.

(Photosensitive Layer-Forming Coating Liquid)

| | |
|---|---|
| Infrared absorber (IR-1: its structure is shown below) | 0.038 part by weight |
| Polymerization initiator A (S-1: its structure is shown below) | 0.061 part by weight |
| Polymerization initiator B (I-1: its structure is shown below) | 0.094 part by weight |
| Mercapto compound (E-1: its structure is shown below) | 0.015 part by weight |
| Polymerizable compound (A-BPE-4: its structure is shown below) (trade name: A-BPE-4; Shin-Nakamura Chemical Co., Ltd.) | 0.425 part by weight |
| Binder polymer A (B-1: its structure is shown below) | 0.311 part by weight |
| Binder polymer B (B-2: its structure is shown below) | 0.250 part by weight |
| Binder polymer C (B-3: its structure is shown below) | 0.062 part by weight |
| Additive (sensitizing aid) (T-1: its structure is shown below) | 0.079 part by weight |
| Polymerization inhibitor (Q-1: its structure is shown below) | 0.0012 part by weight |
| Pigment dispersion described above | 0.137 part by weight |
| Fluorosurfactant (Megaface F-780-F available from Dainippon Ink and Chemicals, Inc.); 30 wt % solution of methyl isobutyl ketone (MIBK)) | 0.0081 part by weight |
| Methyl ethyl ketone (MEK) | 6.000 parts by weight |
| Methanol (MA) | 3.000 parts by weight |
| 1-Methoxy-2-propanol (MFG) | 6.000 parts by weight |

The infrared absorber (IR-1), the polymerization initiator A (S-1), the polymerization initiator B (1-1), the mercapto compound (E-1), the polymerizable compound (A-BPE-4), the binder polymer A (B-1), the binder polymer B (B-2), the binder polymer C (B-3), the additive (T-1) and the polymerization inhibitor (Q-1) which were used in the photosensitive layer-forming coating liquid have the following structures:

(IR-1)
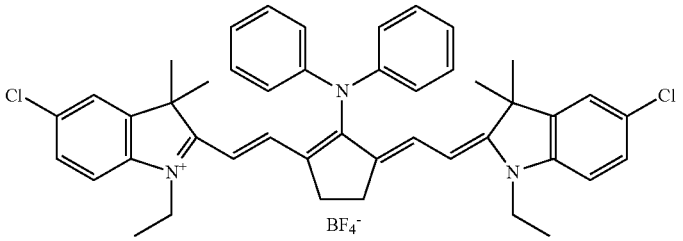
(S-1)
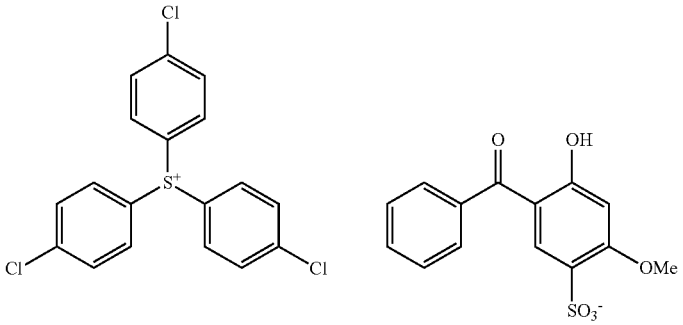
(E-1)
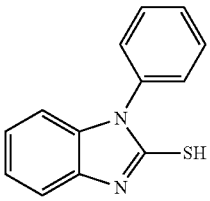
(I-1)
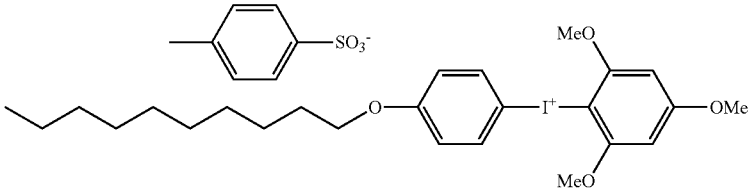
(T-1)
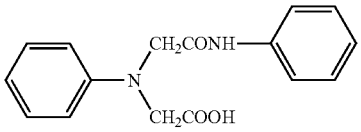
(Q-1)
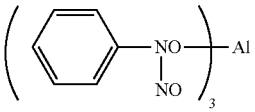
(A-BPE-4)
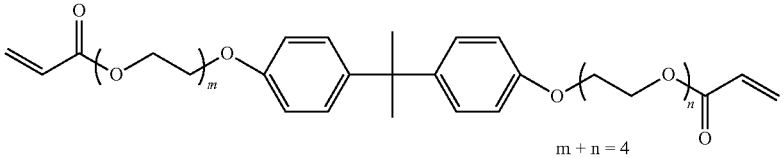
(B-1)
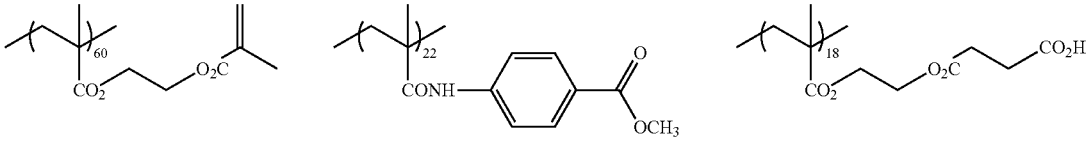

-continued (B-2)

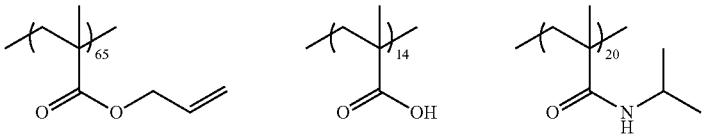

(B-3)

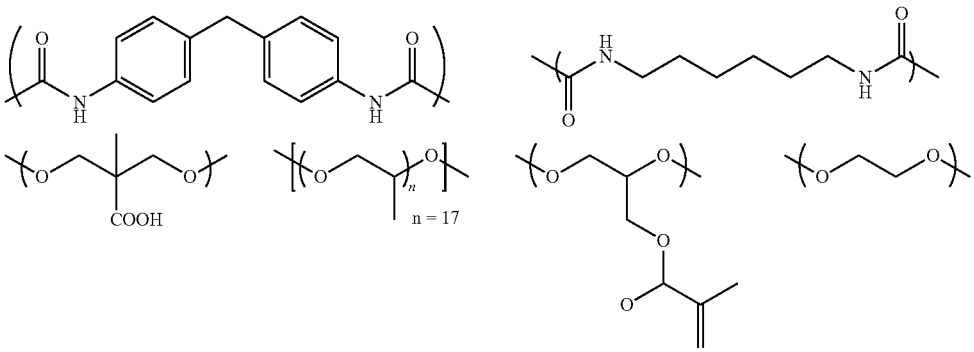

(Formation of Lower Protective Layer)

A mixed aqueous solution (lower protective layer-forming coating liquid) containing a synthetic mica (Somasif MEB-3L; 3.2% aqueous dispersion; Co-Op Chemical Co., Ltd.), polyvinyl alcohol (Gohseran CKS-50; degree of saponification: 99 mol %; degree of polymerization: 300; sulfonic acid-modified polyvinyl alcohol; Nippon Synthetic Chemical Industry Co., Ltd.), a surfactant A (EMALEX 710 available from Nihon Emulsion Co., Ltd.) and a surfactant B (ADEKA Pluronic P-84 available from ADEKA Corporation) was applied with a wire bar onto the photosensitive layer formed, and dried in a hot air drying device at 125° C. for 30 seconds.

The content ratio of the synthetic mica (solids content)/polyvinyl alcohol/surfactant A/surfactant B in the mixed aqueous solution (lower protective layer-forming coating liquid) was 7.5/89/2/1.5 (wt %), and the coating weight after drying was 0.5 g/m$^2$.

(Formation of Upper Protective Layer)

A mixed aqueous solution (upper protective layer-forming coating liquid) containing an organic filler (Art Pearl J-7P available from Negami Chemical Industrial Co., Ltd.), a synthetic mica (Somasif MEB-3L; 3.2% aqueous dispersion; Co-Op Chemical Co., Ltd.), polyvinyl alcohol (L-3266; degree of saponification: 87 mol %; degree of polymerization: 300; sulfonic acid-modified polyvinyl alcohol; Nippon Synthetic Chemical Industry Co., Ltd.), a thickener (Cellogen FS-B available from Dai-ichi Kogyo Seiyaku Co., Ltd.) and a surfactant (EMALEX 710 available from Nihon Emulsion Co., Ltd.) was applied with a wire bar onto the lower protective layer, and dried in a hot air drying device at 125° C. for 30 seconds.

The content ratio of the organic filler/synthetic mica (solids content)/polyvinyl alcohol/thickener/surfactant in the mixed aqueous solution (upper protective layer-forming coating liquid) was 4.8/2.9/69.0/19.0/4.3 (wt %), and the coating weight after drying was 1.2 g/m$^2$.

(Formation of Back Coat Layer and Plate Making Treatment)

A back coat-forming coating liquid was applied with a wire bar onto the surface opposite from the side having the protective layers and dried at 100° C. for 70 seconds to form a back coat layer containing an organic polymer compound thereby obtaining presensitized plates for use in Example 32 and Comparative Example 26. The coating weight was 0.46 g/m$^2$.

(Back Coat-Forming Coating Liquid)

| | |
|---|---|
| Tetraethoxysilane | 2.17 parts |
| Dibutyl maleate | 0.16 part |
| Pyrolgallol resin (weight-average molecular weight: 3,000; its structure is shown below) | 0.16 part |
| Megaface F-780-F (DIC) | 0.005 part |
| Methyl ethyl ketone | 22.5 parts |
| 1-Methoxy-2-propanol | 2.5 parts |

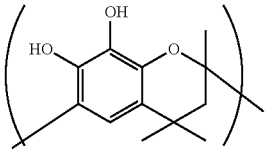

The thus obtained presensitized plates were transported by an auto-loader from the setting section to Trendsetter 3244 (Creo) and a 50% screen tint image was exposed at a resolution of 2,400 dpi using an output power of 7 W, an external surface drum rotation speed of 150 rpm and a plate surface energy of 110 mJ/cm$^2$. The exposed presensitized plates were not heated or washed with water, and were developed in an automatic developing machine LP-1310HII (FUJIFILM Corporation) under the conditions of a transport speed (line speed) of 2 m/min and a development temperature of 30° C. thereby obtaining lithographic printing plates for use in Example 31 and Comparative Example 25. The developer used was DH-N (FUJIFILM Corporation) diluted with water at a ratio of 1/4 and the replenishment developer used was FCT-421 (FUJIFILM Corporation) diluted with water at a ratio of 1/1.4.

(Evaluation of Various Properties)

The presensitized plates or lithographic printing plates obtained in Examples 24 to 31 and Comparative Examples 18 to 25 were used to evaluate various properties including press life, deinking ability after suspended printing, deinking ability in continued printing, on-press developability and scratch resistance. The evaluation methods are described below and the evaluation results are shown in Table 4.

(Press Life (1))

The lithographic printing plates obtained in Examples 24, 25, 27, 28, 29, 30 and 31 and Comparative Examples 18, 19, 21, 22, 23, 24 and 25 were mounted on the plate cylinder of a printing press LITHRONE 26 (Komori Corporation). Printing was made on Tokubishi art paper (76.5 kg) at a printing speed of 10,000 impressions per hour. The press life was evaluated by the number of impressions at the time when the decrease in density of a solid image became visually recognizable. The press life was rated "poor" when the number of impressions was less than 50,000, "fair" when the number of impressions was at least 50,000 but less than 100,000, "good" when the number of impressions was at least 100,000 but less than 150,000, and "excellent" when the number of impressions was 150,000 or more.

(Press Life (2))

The press life of the presensitized plates obtained in Examples 26 and 27 was evaluated according to the same procedure as that used to evaluate the press life of the presensitized plates in Examples 1 to 23. The evaluation criteria are as follows:

Only for the presensitized plates obtained in Example 26 and Comparative Example 20, on-press developability was evaluated according to the same procedure as that used to evaluate the on-press developability of the presensitized plates in Examples 1 to 23. The symbol "-" in Table 4 means that no evaluation was made.

The deinking ability after suspended printing, deinking ability in continued printing and scratch resistance in Examples 24 to 31 and Comparative Examples 18 to 25 were evaluated according to the same procedures as those used in the presensitized plates in Examples 1 to 23.

TABLE 4

| | Press life | Deinking ability after suspended printing | Deinking Ability in Continued Printing | On-press developability | Scratch resistance |
|---|---|---|---|---|---|
| EX 24 | Excellent | Good | Good | — | Good |
| EX 25 | Excellent | Good | Good | — | Good |
| EX 26 | Excellent | Excellent | Excellent | Good | Good |
| EX 27 | Excellent | Good | Good | — | Good |
| EX 28 | Excellent | Good | Good | — | Good |
| EX 29 | Excellent | Good | Good | — | Good |
| EX 30 | Excellent | Good | Good | — | Good |
| EX 31 | Excellent | Good | Good | — | Good |
| CE 18 | Poor | Good | Good | — | Good |
| CE 19 | Poor | Good | Good | — | Good |
| CE 20 | Poor | Excellent | Excellent | Good | Good |
| CE 21 | Poor | Good | Good | — | Good |
| CE 22 | Poor | Good | Good | — | Good |
| CE 23 | Poor | Good | Good | — | Good |
| CE 24 | Poor | Good | Good | — | Good |
| CE 25 | Poor | Good | Good | — | Good |

As is seen from Examples 24 to 31, it was confirmed that also in the presensitized plates which uses the inventive lithographic printing plate support (lithographic printing plate support used in Example 1) and various types of image recording layer, and the lithographic printing plates obtained using the presensitized plates, the press life, deinking ability in continued printing and after suspended printing, on-press developability and scratch resistance were excellent.

On the other hand, the lithographic printing plates and the presensitized plates obtained using the lithographic printing plate support (lithographic printing plate support used in Comparative Example 1) which do not meet the specified average diameters and depths had a short press life.

What is claimed is:

1. A lithographic printing plate support comprising:

an aluminum plate; and an anodized film formed on the aluminum plate, micropores extending in the anodized film in a depth direction from its surface opposite from the aluminum plate, wherein each of the micropores has a large-diameter portion which extends to a depth A of 5 to 60 nm from the surface of the anodized film, and a small-diameter portion which communicates with a bottom of the large-diameter portion and extends to a depth of 900 to 2,000 nm from a communication position between the small-diameter portion and the large-diameter portion, wherein the large-diameter portion has a diameter which gradually increases from the surface of the anodized film toward the aluminum plate, an average bottom diameter of the large-diameter portion as measured at the communication position is larger than a surface layer average diameter of the large-diameter portion as measured at the surface of the anodized film, the average bottom diameter is from 10 to 60 nm, and a ratio of the depth A to the average bottom diameter is 0.1 to 4.0, wherein a small-diameter portion average diameter as measured at the communication position is more than 0 nm but less than 20 nm, and wherein a ratio of the small-diameter portion average diameter to the average bottom diameter is up to 0.85.

2. The lithographic printing plate support according to claim 1, wherein the anodized film has a thickness of at least 20 nm between a bottom of the small-diameter portion and a surface of the aluminum plate.

3. The lithographic printing plate support according to claim 1, wherein the micropores are formed at a density of 100 to 3,000 micropores/$\mu m^2$.

4. A method of manufacturing the lithographic printing plate support according to claim 1, the method comprising:

a first anodizing treatment step for anodizing the aluminum plate; and a second anodizing treatment step for further anodizing the aluminum plate having the anodized film obtained in the first anodizing treatment step.

5. A presensitized plate comprising:

the lithographic printing plate support according to claim 1; and an image recording layer formed thereon.

6. The presensitized plate according to claim 5, wherein the image recording layer is one in which an image is formed by exposure to light and unexposed portions are removable by printing ink and/or fountain solution.

7. A method of manufacturing the lithographic printing plate support according to claim 2, the method comprising:

a first anodizing treatment step for anodizing the aluminum plate; and a second anodizing treatment step for further anodizing the aluminum plate having the anodized film obtained in the first anodizing treatment step.

8. A presensitized plate comprising:

the lithographic printing plate support according to claim 2; and an image recording layer formed thereon.

9. The presensitized plate according to claim 8, wherein the image recording layer is one in which an image is formed by exposure to light and unexposed portions are removable by printing ink and/or fountain solution.

* * * * *